US005708953A

United States Patent [19]

Morigami et al.

[11] Patent Number: 5,708,953

[45] Date of Patent: Jan. 13, 1998

[54] COPYING SYSTEM PROVIDED WITH AN AUTOMATIC DOCUMENT FEEDER AND A COPY SHEET CIRCULATING DEVICE

[75] Inventors: Yuusuke Morigami, Toyohashi; Shinobu Seki, Toyokawa, both of Japan

[73] Assignee: Minolta Co., Ltd., Osaka, Japan

[21] Appl. No.: 729,067

[22] Filed: Oct. 10, 1996

[30] Foreign Application Priority Data

Oct. 12, 1995 [JP] Japan ..... 7-264307
Sep. 20, 1996 [JP] Japan ..... 8-250260

[51] Int. Cl.[6] ..... G03G 21/00

[52] U.S. Cl. ..... 399/364; 399/374

[58] Field of Search ..... 399/364, 373, 399/374; 271/291

[56] References Cited

U.S. PATENT DOCUMENTS 4,278,344 7/1981 Sahay ..... 399/374
4,456,236 6/1984 Buddendeck .

*Primary Examiner*—R. L. Moses
*Attorney, Agent, or Firm*—McDermott, Will, & Emery

[57] ABSTRACT

A copying system which has a copying machine for forming an image on a sheet, a circular transporting device for receiving a sheet which has obtained an image on one side from the copying machine and refeeding the sheet to the copying machine for image formation on the other side of the sheet, and an automatic document feeder with a document reversing mechanism. The automatic document feeder sets a document at a specified position on a document table and discharges the document from the document table. Further, in handling a double-side document which has images on both sides, the automatic document feeder turns over the document after scanning of an image of one side. When a number of copies over the capacity of the circular transporting device are to be made in a double-side document/duplex copy mode, the document is turned over every time a number of copies corresponding to the capacity of the circular transporting device has been made.

7 Claims, 36 Drawing Sheets

FIG. 13

| FEED TIMING | | | ROTATION OF TRANSFER DRUM | | | | | | | | | | | | | | | | | | |
|---|---|---|---|---|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 | 15 | 16 | 17 | 18 | 19 |
| SINGLE-SIDE DOCUMENT/ SIMPLEX COPYING | SINGLE HOLDING | 1 COLOR | 1 | 1 | 1 | 1 | 1 | 1 | 1 | 1 | 1 | 1 | 1 | 1 | 1 | 1 | 1 | 1 | 1 | 1 | 1 |
| | | 2 COLORS | 1 | | 1 | | 1 | | 1 | | 1 | | 1 | | 1 | | 1 | | 1 | | 1 |
| | | 3 COLORS | 1 | | | 1 | | | 1 | | | 1 | | | 1 | | | 1 | | | 1 |
| | | 4 COLORS | 1 | | | | 1 | | | | 1 | | | | 1 | | | | 1 | | |
| | DOUBLE HOLDING | 1 COLOR | 2 | 2 | 2 | 2 | 2 | 2 | 2 | 2 | 2 | 2 | 2 | 2 | 2 | 2 | 2 | 2 | 2 | 2 | 2 |
| | | 2 COLORS | 2 | | 2 | | 2 | | 2 | | 2 | | 2 | | 2 | | 2 | | 2 | | 2 |
| | | 3 COLORS | 2 | | | 2 | | | 2 | | | 2 | | | 2 | | | 2 | | | 2 |
| | | 4 COLORS | 2 | | | | 2 | | | | 2 | | | | 2 | | | | 2 | | |

FIG. 14

| FEED/REFEED TIMING | | | | ROTATION OF TRANSFER DRUM | | | | | | | | | | | | | | | | | | |
|---|---|---|---|---|---|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 | 14 | 15 | 16 | 17 | 18 | 19 |
| DOUBLE-SIDE DOCUMENT/ DUPLEX COPYING | SINGLE HOLDING | 1 COLOR | FEED | 1 | 1 | | | | 1 | 1 | | | | 1 | 1 | | | | 1 | 1 | | |
| | | | REFEED | | | | 1 | 1 | | | | 1 | 1 | | | | 1 | 1 | | | | 1 |
| | | 2 COLORS | FEED | 1 | | 1 | | | | | | 1 | | 1 | | | | | | 1 | | 1 |
| | | | REFEED | | | | | 1 | | 1 | | | | | | 1 | | 1 | | | | |
| | | 3 COLORS | FEED | 1 | | | 1 | | | | | | | | | 1 | | | 1 | | | |
| | | | REFEED | | | | | | | 1 | | | 1 | | | | | | | | | 1 |
| | | 4 COLORS | FEED | 1 | | | | 1 | | | | | | | | | | | | 1 | | |
| | | | REFEED | | | | | | | | | 1 | | | | 1 | | | | | | |
| | DOUBLE HOLDING | 1 COLOR | FEED | 2 | | 2 | | | | 2 | | 2 | | | | 2 | | 2 | | | | 2 |
| | | | REFEED | | | | 2 | | 2 | | | | 2 | | 2 | | | | 2 | | 2 | |
| | | 2 COLORS | FEED | 2 | | 2 | | | | | | 2 | | 2 | | | | | | 2 | | 2 |
| | | | REFEED | | | | | 2 | | 2 | | | | | | 2 | | 2 | | | | |
| | | 3 COLORS | FEED | 2 | | | 2 | | | | | | | | | 2 | | | 2 | | | |
| | | | REFEED | | | | | | | 2 | | | 2 | | | | | | | | | 2 |
| | | 4 COLORS | FEED | 2 | | | | 2 | | | | | | | | | | | | 2 | | |
| | | | REFEED | | | | | | | | | 2 | | | | 2 | | | | | | |

FIG. 15

(MONOCOLOR COPYING)

| FEED/REFEED TIMING | | | ROTATION OF TRANSFER DRUM | | | | | | | |
|---|---|---|---|---|---|---|---|---|---|---|
| | | | 1 | 2 | 3 | 4 | 5 | 6 | 7 | 8 |
| DUPLEX COPYING | SINGLE HOLDING | PASS-BY MODE | FEED | 1 | 1 | | | | | |
| | | | REFEED | | | 1 | 1 | | | |
| | | STAND-BY MODE | FEED | 1 | | | 1 | | | |
| | | | REFEED | | 1 | | | | 1 | |
| | DOUBLE HOLDING | PASS-BY MODE | FEED | 2 | 2 | | | | | |
| | | | REFEED | | | 2 | | 2 | | |
| | | STAND-BY MODE | FEED | 2 | | | 2 | | | |
| | | | REFEED | | 2 | | | | 2 | |

COPYING SYSTEM PROVIDED WITH AN AUTOMATIC DOCUMENT FEEDER AND A COPY SHEET CIRCULATING DEVICE

BACKGROUND OF THE INVENTION

1. Field of the Invention

The present invention relates to a copying system, and more particularly to a copying system which can carry out duplex copying (forming images on both sides of a sheet) of a double-side document (document with images on both sides).

2. Description of Related Art

In the art of copying system, as a duplex copying mechanism which enables a sheet to obtain images on both sides, a stack type and a circulating type are well known. In a copying system with a stack type duplex copying mechanism, sheets each of which obtained an image on one side are turned over and stacked on an intermediate tray, and then the sheets are refed to a transfer section from the intermediate tray one by one. In a copying system with a circulating type duplex copying mechanism, a sheet which obtained an image on one side is transported from a transfer section to a refeeding section, turned over on the way, and the sheet is refed to the transfer section.

The stack type duplex copying mechanism has an advantage of permitting continuous duplex copying within the capacity of the intermediate tray (generally approximately 50 sheets). However, the cost of the stack type is high, and the stack type needs a large space, thereby increasing the size of the system. The circulating type duplex copying mechanism has advantages that the cost is low and that only a small space is necessary. However, the circulating type permits continuous duplex copying only within the capacity of a circular path, and the capacity, which depends on the size of sheets, is two to four sheets. If a copying machine of the copying system has a memory which stores image data of a document, even with the circulating type duplex copying mechanism, continuous duplex copying over the capacity of the circular path is possible. However, the memory is expensive, and this is not suitable for a compact copying system.

SUMMARY OF THE INVENTION

It is an object of the present invention to provide a copying system which has an inexpensive and compact circulating type duplex copying mechanism and which can carry out continuous duplex copying over the capacity of a circular path without a memory.

In order to attain the object, a copying system according to the present invention is a combination of copying means for forming an image on a sheet, sheet transporting means for receiving a sheet with an image formed on one side from the copying means and refeeding the sheet to the copying means for image formation on the other side of the sheet, and an automatic document feeder provided with document reversing means. The automatic document feeder feeds and sets a document at a specified position on a document table, and discharges the document from the document table. In handling a double-side document, which has images on both sides, after image scanning of one side of the document, the sheet reversing means turns over the document and sets the document at the specified position on the document table again. A feature of the present invention is that to make a number of copies over the capacity of the sheet transporting means in a double-side document/duplex copy mode, the document is turned over every time a number of copies corresponding to the capacity of the sheet transporting means have been made.

For example, if the capacity of the sheet transporting means is two sheets and if six duplex copies of a double-side document is requested, a copying operation is carried out as follows. First, a back side (page 2) of the document is copied on respective first sides of two sheets continuously. Thereafter, the two sheets are delivered to the sheet transporting means, and the document is turned over. Then, the two sheets are refed to the copying means, and a front side (page 1) of the document is copied on respective second sides of the sheets. This cycle of making two duplex copies is repeated until six duplex copies are made.

Thus, according to the present invention, even a copying system with a circulating type duplex copying mechanism, further with an automatic document feeder with sheet reversing means, can make a desired number of copies in a copying operation (an operation carried out by one push of a start key) by repeating reversion of a document.

However, unlimited repetitions of reversion of a document may damage the document and/or may cause transportation trouble such as a paper jam. It is preferred to set a limit to the number of times of reversion of a document in order to avoid such trouble. According to the present invention, when the number of copies inputted by an operator over a copy limit which is calculated from the capacity of the sheet transporting means and the limit to the number of times of reversion of a document, a copying operation to make only the limited number of copies is carried out regardless of the inputted number of copies.

Further, preferably, the limit set to the number of times of reversion of a document depends on the kind of the document. Thin paper is more likely to be damaged than thick paper. It is also preferred that the limit can be selected by an operator.

BRIEF DESCRIPTION OF THE DRAWINGS

This and other objects and features of the present invention will be apparent from the following description with reference to the accompanying drawings, in which:

FIG. 13 is a chart which shows feed timing in a single-side document/simplex copy mode;

FIG. 14 is a chart which shows feed timing in a double-side document/duplex copy mode;

FIG. 15 is a chart which shows feed timing and refeed timing in the duplex copy mode using one color;

DETAILED DESCRIPTION OF THE PREFERRED EMBODIMENTS

A copying system which is an embodiment of the present invention is described with reference to the accompanying drawings.

Figure 1:
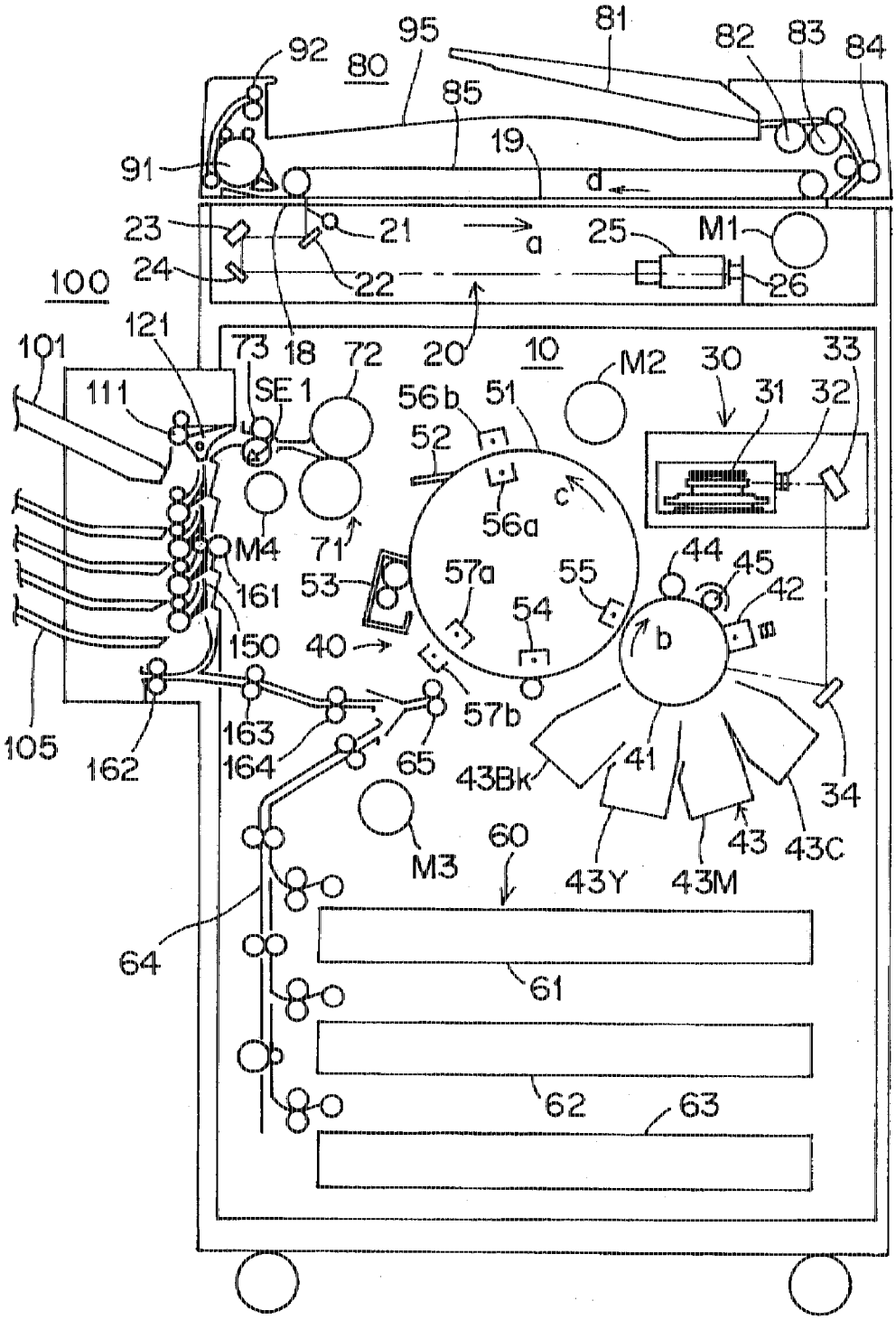
FIG. 1 is a schematic view of a copying system which is an embodiment of the present invention.

FIG. 1 is a schematic view of the copying system.

The copying system comprises a full color copying machine 10, an automatic document feeder 80 which is disposed on the copying machine 10, and a duplex sorter 100 which is disposed on a side of the copying machine 10.

The copying machine 10 has an image reader unit 20 in an upper portion, a laser beam scanning unit 30 and a full color image forming section 40 in a middle portion, and a feeding section 60 in a lower portion.

The image reader unit 20 is to read an image of a document placed on a document glass 19. The image reader unit 20 comprises an illuminating lamp 21, mirrors 22, 23, 24, a lens 25, a color CCD 26 and a scan motor M1. In order to read an image, the illuminating lamp 21 and the mirror 22 move in a direction of arrow a at a speed of v/m (v: circumferential speed of a photosensitive drum 14 (fixed speed at any copy magnification), m: copy magnification), and the mirrors 23 and 24 move in the direction of arrow a at a speed of v/2m. A document is set on the document glass 19 with an edge in contact with a document scale 18. A light emitted from the illuminating lamp 21 is reflected on a surface of the document and is incident to the CCD 26 via the mirrors 22, 23, 24 and the lens 25. The CCD 26 reads the image of the document as color signals of three principal colors, namely, R (red), G (green) and B (blue). The multi-value electric signals which were obtained by photoelectric conversion of the CCD 26 are converted into eight-bit print data which indicate four colors, namely, Y (yellow), M (magenta), C (cyan) and Bk (black) by an image signal processing section (not shown). Then, the print data are subjected to edit processing and transmitted to the laser beam scanning unit 30.

The laser beam scanning unit 30 is a conventional type which modulates a laser diode in accordance with the print data to form an electrostatic latent image on a photosensitive drum 41 which rotates in a direction of arrow b. A laser beam emitted from the laser diode is deflected by a polygon mirror 31 and illuminates the photosensitive drum 41 via an fθ lens 32, mirrors 33 and 34.

The principal members of the full color image forming section 40 are the photosensitive drum 41 and a transfer drum 51. Around the photosensitive drum 41, there are provided an electrify charger 42, a full color developing unit 43, a residual toner cleaner 44 and a residual charge eraser 45 in order along the rotation of the photosensitive drum 41 (direction of arrow b). The developing unit 43 comprises developing devices 43C, 43M, 43Y and 43Bk which contain developers containing cyan toner, magenta toner, yellow toner and black toner, respectively. Each time an electrostatic latent image of a color is formed on the photosensitive drum 41, the corresponding developing device is driven.

The transfer drum 51 is driven to rotate in a direction of arrow c at the same circumferential speed as the photosensitive drum 41 to transfer a toner image from the photosensitive drum 41 to a sheet wound therearound. The transfer drum 51 has a holding claw (not shown) for holding an edge of a sheet, a peeling claw for peeling a sheet off the transfer drum 51 and a residual toner cleaner 53. Further, inside and outside of the transfer drum 51, there are provided a sheet attracting charger 54, a transfer charger 55, erasing chargers **56*a*, 56*b*, 57*a* and 57*b***.

The circumference of the transfer drum 51 is long enough to hold a sheet of A3T size which is the maximum size to be handled in this system. The "T" means a case in which a sheet is transported in the system with the longer sides parallel to the transporting direction. A "Y" means a case in which a sheet is transported in the system with the shorter sides parallel to the transporting direction. In handling sheets of sizes smaller than a half of A3T (A4Y, A5T, A5Y, B5Y), in order to improve the copy productivity, the transfer drum 51 holds two sheets at a time (double holding). For this purpose, the transfer drum 51 has two holding claws on symmetrical positions of 180°. Further, the transfer drum 51 has an actuator (not shown) which turns on and off a sensor for detecting a reference position of rotation.

The feeding section 60 has three feed cassettes 61, 62 and 63. A sheet which is fed from one of the cassettes 61, 62 and 63 is transported upward in a transport path 64 and stopped at a timing roller pair 65. Then, the sheet is fed to the transfer drum 51 at a specified timing and held around the transfer drum 51.

In making a full color copy, a cyan image, a magenta image, a yellow image and a black image are formed on the photosensitive drum 41 and are transferred to a sheet held around the transfer drum 51 by discharge from the transfer charger 55 one by one, whereby the images are laid one upon another on the sheet. Upon completion of the transfer of the four images, the charge on the sheet is erased by discharge from the chargers 56a and 56b, and the sheet is peeled off the transfer drum 51 by the peeling claw 52. The sheet is transported to a fixing device 71, where the toner images are fixed on the sheet by a fixing roller pair 72. Then, the sheet is transported into the duplex sorter 100 via a discharging roller pair 73.

In the present embodiment, a full color copy can be made by overlaying three color images as well as by overlaying four color images. Also, a monochromatic copy using only black toner, a monocolor copy of a desired single color and a bicolor copy of desired two colors are available. The transfer drum 51 rotates according to the number of colors to be overlaid. The photosensitive drum 41 and the transfer drum 51 are driven by a main motor M2. The rollers of the feeding section 60 are driven by a feed motor M3. The fixing roller pair 72 and the discharging roller pair 73 are driven by a fixing motor M4. Between each of the motors M2, M3 and M4 and the driven members, a clutch (not shown) which connects and disconnects the power is provided.

The automatic document feeder 80 feeds and transports documents set on a document stacker 81 onto the document glass 19 one by one, and each time image reading of a document by the image reader unit 20 is completed, the automatic document feeder 80 discharges the document onto a tray 95. In order to feed a document from the stacker 81, there are provided a feed roller 82, a separating roller pair 83 and a resist roller pair 84. Documents are set on the stacker 81 with a first page facing up, and feeding begins with the lowermost document (last page). A document is fed out of the stacker 81 by the feed roller 82 and fed onto the document glass 19 through the roller pairs 83 and 84. A conveyer belt 85 which is rotatable in both forward and reverse directions is disposed on an upper surface of the document glass 19. By forward rotation of the conveyer belt 85 indicated by arrow d, the document fed from the resist roller pair 84 is set on the document glass 19 with reference to the document scale 18.

At the left side of the automatic document feeder 80, there are provided a discharging/reversing roller 91 and an ejecting roller pair 92. In handling a single-side document (a document with an image only on one side), after image reading, the conveyer belt 85 is rotated forward in the direction of arrow d, and the single-side document is transported around the discharging/reversing roller 91 and ejected onto the tray 95 through the ejecting roller pair 92 with the image-bearing side facing up. This mode of transporting a document is referred to as single-side document mode.

Next, handling of a double-side document (a document with images on both sides) is described. A double-side document fed onto the document glass 19 from the resist roller pair 84 passes over the document glass 19 and turns around the discharging/reversing roller 91 once, whereby the document is turned over. Then, the conveyer belt 85 is rotated in reverse in a direction opposite to arrow d until the trailing edge of the document comes to the document scale 18. In this state, image reading of a back side of the document is carried out. After the image reading, the document is transported around the discharging/reversing roller 91 again and turned over again. Thereby, the document is set on the document glass 19 with a front side facing down, and image reading of the front side is carried out. After the image reading, the document is ejected onto the tray 95 through the discharging/reversing roller 91 and the ejection roller pair 92. This mode of transporting a document is referred to as double-side document mode.

Although it is not shown, a pawl is provided around the discharging/reversing roller 91 to change the ejecting/reversing path. Further, a sensor for detecting a document is provided in the stacker 81; a sensor for detecting a document fed out of the stacker 81 and a sensor for detecting the size of the document are provided near the resist roller pair 84; and a sensor for detecting a document is provided near the discharging/reversing roller 91.

The automatic document feeder 80 is wholly pivotable on the rear side of the copying machine 10 so that an operator can set a document on the document glass 19 manually.

Next, the duplex sorter 100 is described.

Figure 2:
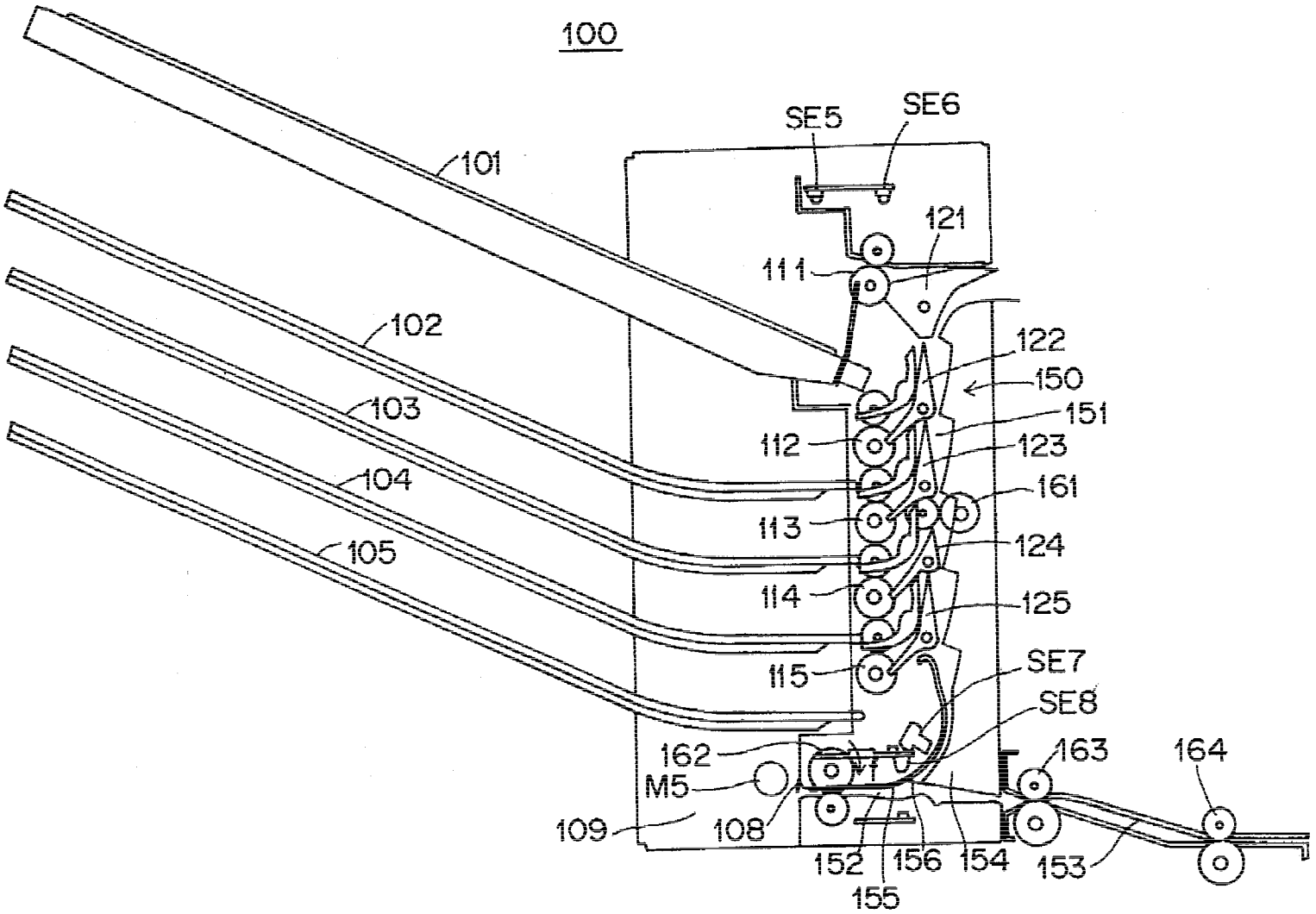
FIG. 2 is a schematic view of a duplex sorter which is provided in the copying system of FIG. 1.

As shown in FIG. 2, the duplex sorter 100 comprises five sheet bins 101, 102, 103, 104, 105 and a sheet circulating section 150.

At the respective entrances of the bins 101 through 105, storing roller pairs 111, 112, 113, 114, 115 and change-over pawls 121, 122, 123, 124, 125 for change over the path of a sheet are provided. The sheet circulating section 150 comprises a vertical path 151 with a vertical transport roller pair 161, a switchback path 152 with a switchback roller pair 162 and a horizontal path 153 with a refeeding roller pairs 163 and 164.

In a non-sort mode, sheets are stored in the first (uppermost) bin 101. In a sort mode, sheets are delivered among the five bins in order from the first bin 101. In a duplex copy mode, when copying of an image onto a first side of a sheet is completed, the sheet is transported to the switchback path 152 through the vertical path 151 and switchbacked by the switchback roller pair 162 as will be described later. Then, the sheet is transported to the horizontal path 153 and to the timing roller pair 65.

The sensor SE5 has an optical axis which passes through frontages of the bins 101 through 105 to detect a sheet on each of the bins 101 through 105. The sensor SE6 has an optical axis which passes through portions immediately before the entrances of the bins 101 through 105 to detect a sheet being transported into each of the bins 101 through 105.

The transporting roller pairs 111 through 115 and the vertical transport roller pair 161 are connected to the fixing motor M4 of the copying machine 10 via a clutch. Especially with respect to the vertical transport roller pair 161, by disconnecting the clutch temporarily, a sheet being transported in the vertical path 151 is stopped once.

The switchback roller pair 162 is connected to a reversible switchback motor M5 via a clutch. The roller pair 162 is driven to rotate forward and in reverse by the motor M5, and when the clutch is disconnected, the roller pair 162 freely rotates. The refeeding roller pairs 163 and 164, which are to feed a sheet to the timing roller pair 65 of the copying machine 10, are connected to the feed motor M3 via a clutch. By disconnecting the clutch temporarily, a sheet being transported in the horizontal path 153 is stopped once.

A sensor SE7 is provided to detect a sheet in a lower portion of the vertical path 151, and a sensor SE8 is provided to detect a sheet in an entrance/exit portion of the switchback path 152.

Next, the change-over pawls 121 through 125 are described.

Figure 3:
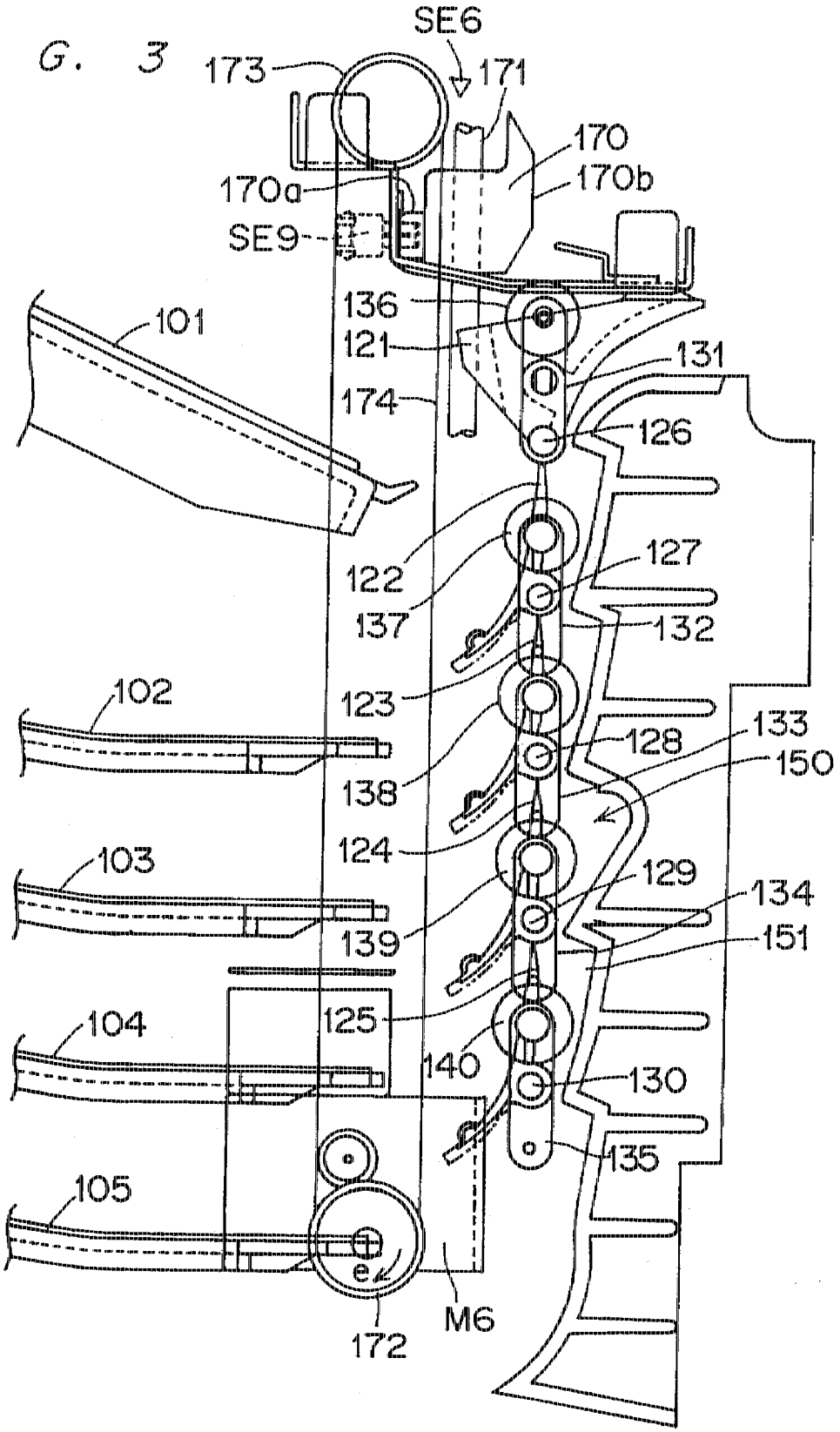
FIG. 3 is an elevational view of the duplex sorter showing a path change-over mechanism.

As shown in FIG. 3, the change-over pawls 121 through 125 are rotatably fastened to shafts 126 through 130. Levers 131 through 135 are fixed to the pawls 121 through 125 respectively, and rollers 136 through 140 are rotatably fitted at respective one ends of the levers 131 through 135.

A cam 170 is provided to actuate the change-over pawls 121 through 125. The cam 170 is movable up and down along a guide shaft 171 and is fitted to a belt 174 which is laid between a driving pulley 172 and a driven pulley 173. The driving pulley 172 is driven by a reversible change-over motor M6. When the motor M6 runs forward to rotate the pulleys 172 and 173 in a direction of arrow e, the belt 174 rotates in the same direction, and accordingly the cam 170 moves down. The change-over pawls 121 through 125 are urged in a counterclockwise direction in FIG. 3 by torsion springs (not shown) wound around the shafts 126 through 130 to be in respective positions shown in FIG. 3. The cam 170, in the initial state, is in a home position shown in FIG. 3. While a sensor SE9 detects a projection 170*a* of the cam 170, it is recognized that the cam 170 is in the home position.

In the non-sort mode, the cam 170 moves down from the home position by one step, and a side surface 170*b* of the cam 170 pushes the roller 136. Accordingly, the change-over pawl 121 turns clockwise (see FIG. 4). In this state, when a sheet $P_1$ is discharged from the copying machine 10, the sheet $P_1$ is guided onto the first bin 101 by an upper surface 121*a* of the change-over pawl 121.

Figure 4:
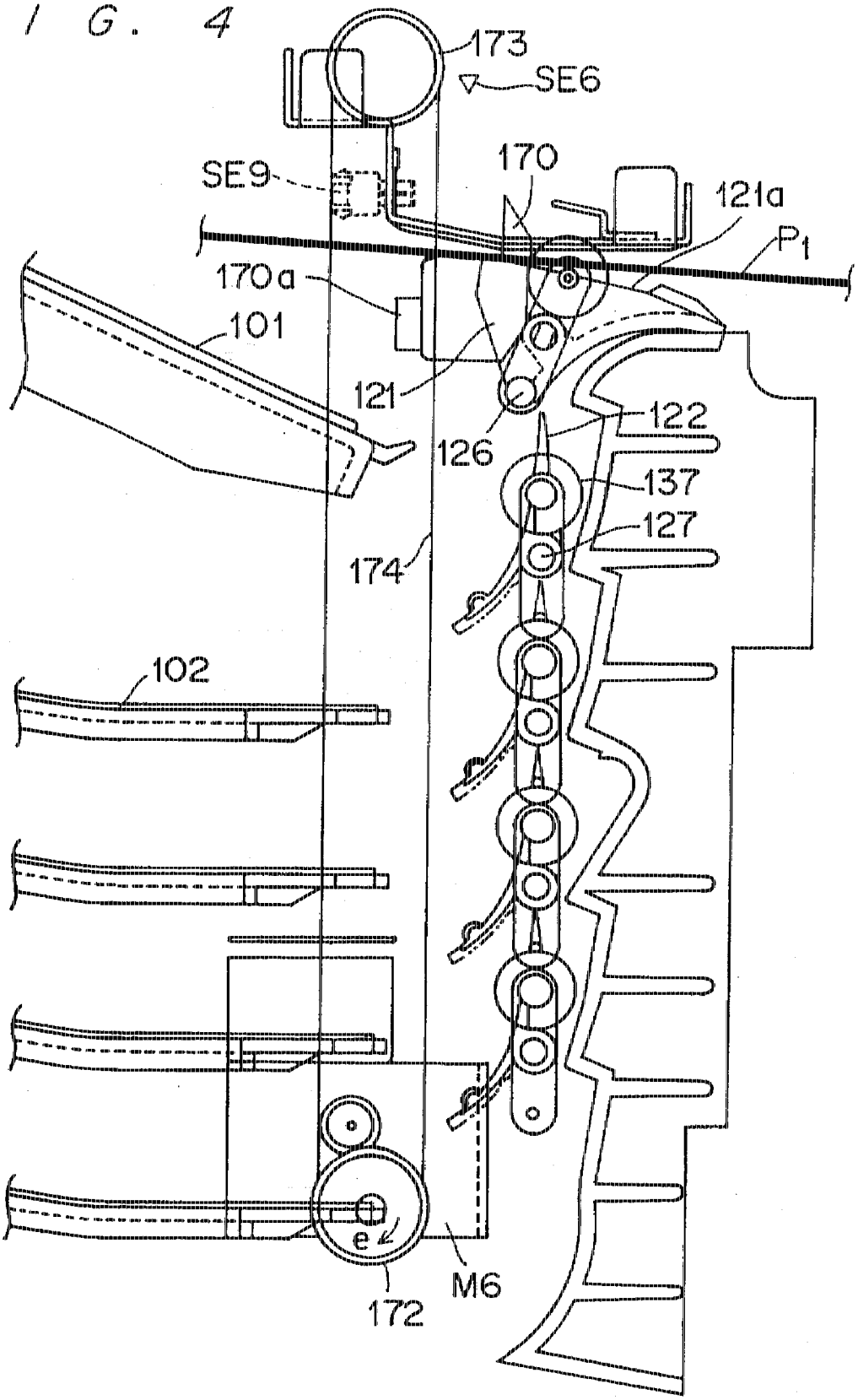
FIG. 4 is an elevational view of the duplex sorter which is operating in a non-sort mode.
Figure 5:
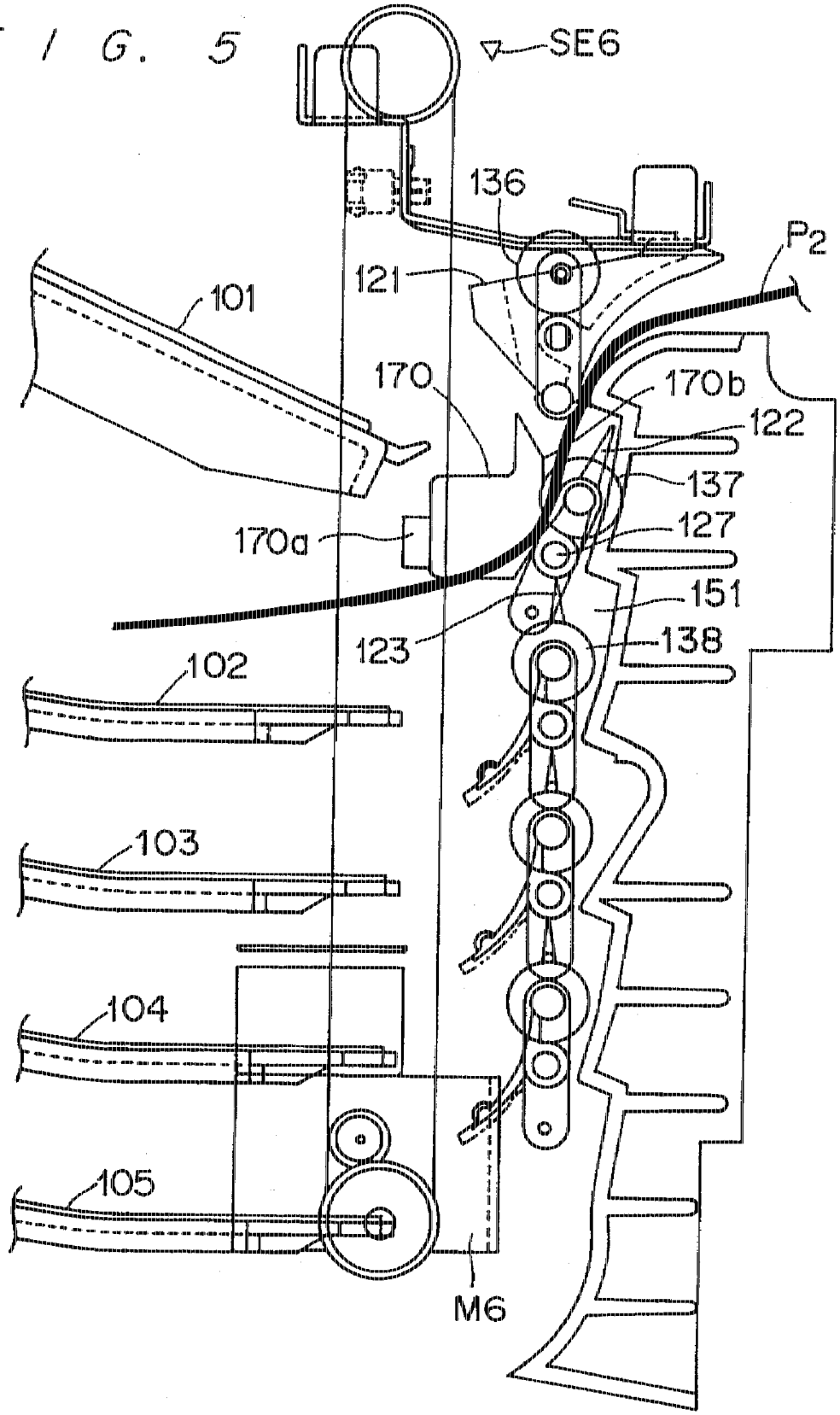
FIG. 5 is an elevational view of the duplex sorter when a sheet is delivered to a second bin in a sort mode.

In the sort mode, when a first sheet $P_1$ is discharged from the copying machine 10, the cam 170 is set in the position shown in FIG. 4 to pivot the change-over pawl 121. When the trailing edge of the sheet $P_1$ is detected by the sensor SE6, the motor M6 rotates forward to move down the cam 170 by one step. Thereby, the side surface 170*b* of the cam 170 pushes the roller 137, and accordingly, the second change-over pawl 122 turns clockwise (see FIG. 5). Meanwhile, the roller 136 becomes free from the force of the cam 170, and the first change-over pawl 121 returns counterclockwise. In this state, when a second sheet $P_2$ is discharged from the copying machine 10, the sheet $P_2$ is guided into the vertical path 151 by a side surface of the first pawl 121 and guided onto the second bin 102 by a side surface of the second pawl 122. When the trailing edge of the sheet $P_2$ is detected by the sensor SE6, the motor M6 rotates forward to move down the cam 170 by one step. Thereby, the side surface 170*b* of the cam 170 pushes the roller 138, and accordingly the third change-over pawl 123 turns clockwise. Meanwhile, the second pawl 122 returns clockwise. In this state, a third sheet $P_3$ discharged from the copying machine 10 is guided into the vertical path 151 by the side surface of the first pawl 121 and guided onto the third bin 103 by a side surface of the third pawl 123. Thereafter, the cam 170 moves down step by step in the same way to deliver succeeding sheets to the forth bin 104 and the fifth bin 105.

In the duplex copy mode, when an image is copied on a first side of a sheet, the cam 170 is in the home position shown in FIG. 3. Accordingly, the sheet is guided into the vertical path 151 by the side surface of the first pawl 121 and transported downward by the vertical transport roller pair 161. Then, the leading edge of the sheet comes to the switchback roller pair 162. When a specified time passes after detection of the leading edge of the sheet by the sensor SE7, that is, immediately before the leading edge of the sheet reaches the switchback roller pair 162, the switchback motor M5 is driven forward to rotate the upper of the roller pair 162 in a direction of arrow f (the lower roller rotates following the upper roller). Then, the sheet is transported to a space 109 of the duplex sorter 100 by the forward rotation of the switchback roller pair 162. Further, a charge erasing brush 108 is provided near the switchback roller pair 162 to erase the charge on a sheet being transported to the space 109.

Subsequently, when a specified time passes after detection of the trailing edge of the sheet by the sensor SE8, that is, immediately before the trailing edge of the sheet passes through the switchback roller pair 162, the switchback motor M5 is reversed. Thereby, the switchback roller pair 162 is rotated in a direction opposite to arrow f, and the sheet is switchbacked and guided to the horizontal path 153. Then, the sheet is transported to right by the refeeding roller pairs 163 and 164 and fed back to the copying machine 10 for image formation on a second side of the sheet.

Figure 6:
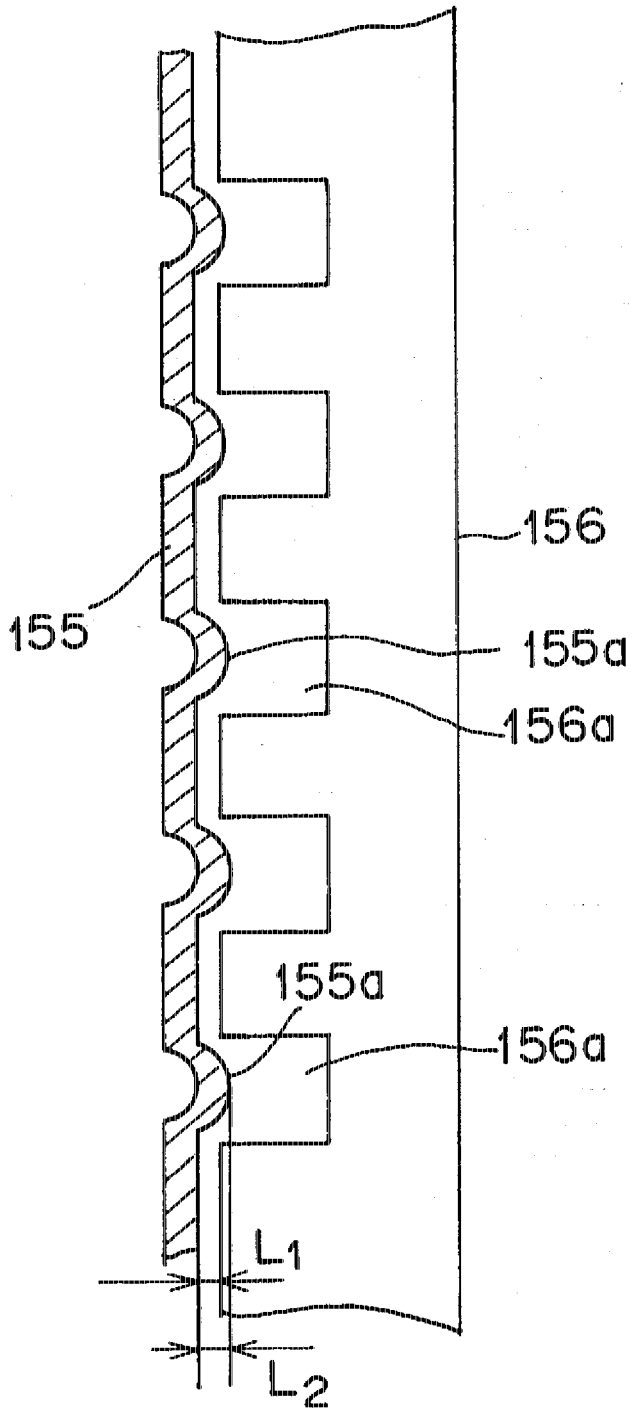
FIG. 6 is a sectional view of a junction of a circulating section in the duplex sorter.

At the junction of the paths 151, 152 and 153, a flexible resin sheet 156 is provided. More specifically, the resin sheet 156 is stuck on a corner of a guide plate 154, and the end portion of the resin sheet 155 is opposite a guide plate 155. As shown in FIG. 6, the guide plate 155 has ribs 155*a* extending in the sheet transporting direction so as to decrease the area in contact with a sheet, thereby preventing the sheet from adhering to the guide plate 155. The end portion of the resin sheet 156 has grooves 156*a* which matches the ribs 155*a*. The distance $L_1$ between the resin sheet 156 and the guide plate 155 is smaller than the height $L_2$ of the ribs 155*a*. When the sheet is transported from the vertical path 151 to the switchback path 152, the leading edge of the sheet pushes the resin sheet 156 open. Then, when the switchback roller pair 162 is reversed, the sheet switchbacked thereby is guided to the horizontal path 153 and prevented from going back to the vertical path 151 by the resin sheet 151.

In the horizontal path 153, the sheet is transported to right by the refeeding roller pairs 163 and 164. Then, when the leading edge of the sheet comes into contact with the timing roller pair 65 and is slightly bent, the refeeding roller pairs 163 and 164 are stopped. This state continues until a control section sends a refeed command. Upon receipt of the refeed command, the sheet is refed to the transfer drum 51 through the timing roller pair 65 for image formation on a second side of the sheet.

In the duplex copy mode, in a case in which two sheets are held on the transfer drum 51 at a time (double holding), the duplex sorter 100 is operative in two modes.

Figure 7:
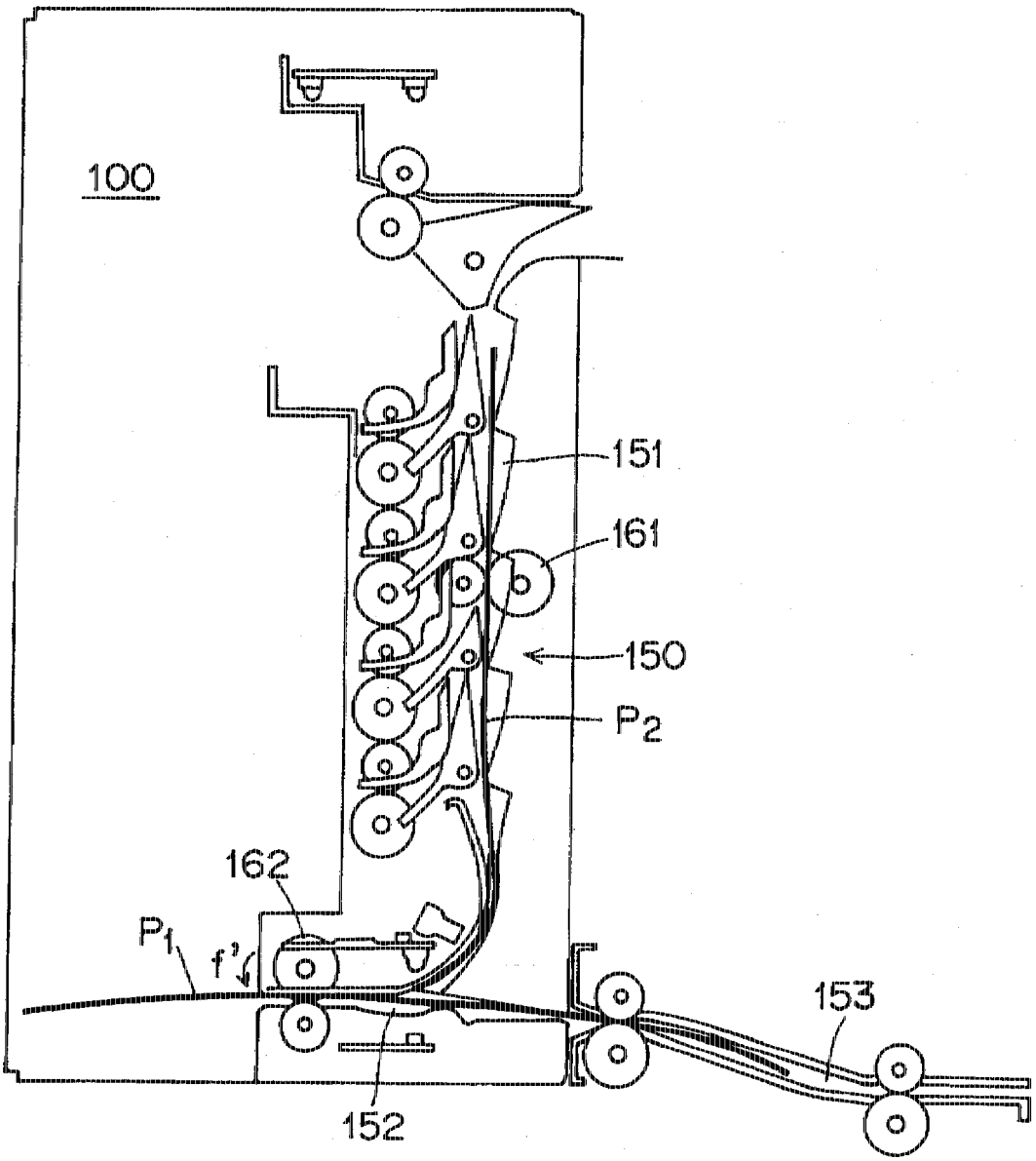
FIG. 7 is an illustration of the circulating section showing transportation of sheets.

Two sheets held by the transfer drum 51 at a time, after image transfer, are peeled off the transfer drum 51 and transported into the duplex sorter 100 at a small interval. Accordingly, as FIG. 7 shows, before the trailing edge of a first sheet $P_1$ which was switchbacked and transported toward the horizontal path 153 passes through the switchback roller pair 162, a second sheet $P_2$ which was guided into the vertical path 151 reaches the switchback roller pair 162. In this moment, the switchback roller pair 162 is rotating in reverse in the direction of arrow f', and the second sheet $P_2$ cannot comes between the switchback roller pair 162, thereby causing a paper jam. In order to avoid this trouble, in the present embodiment, a stand-by mode and a pass-by mode are available.

Figure 8:
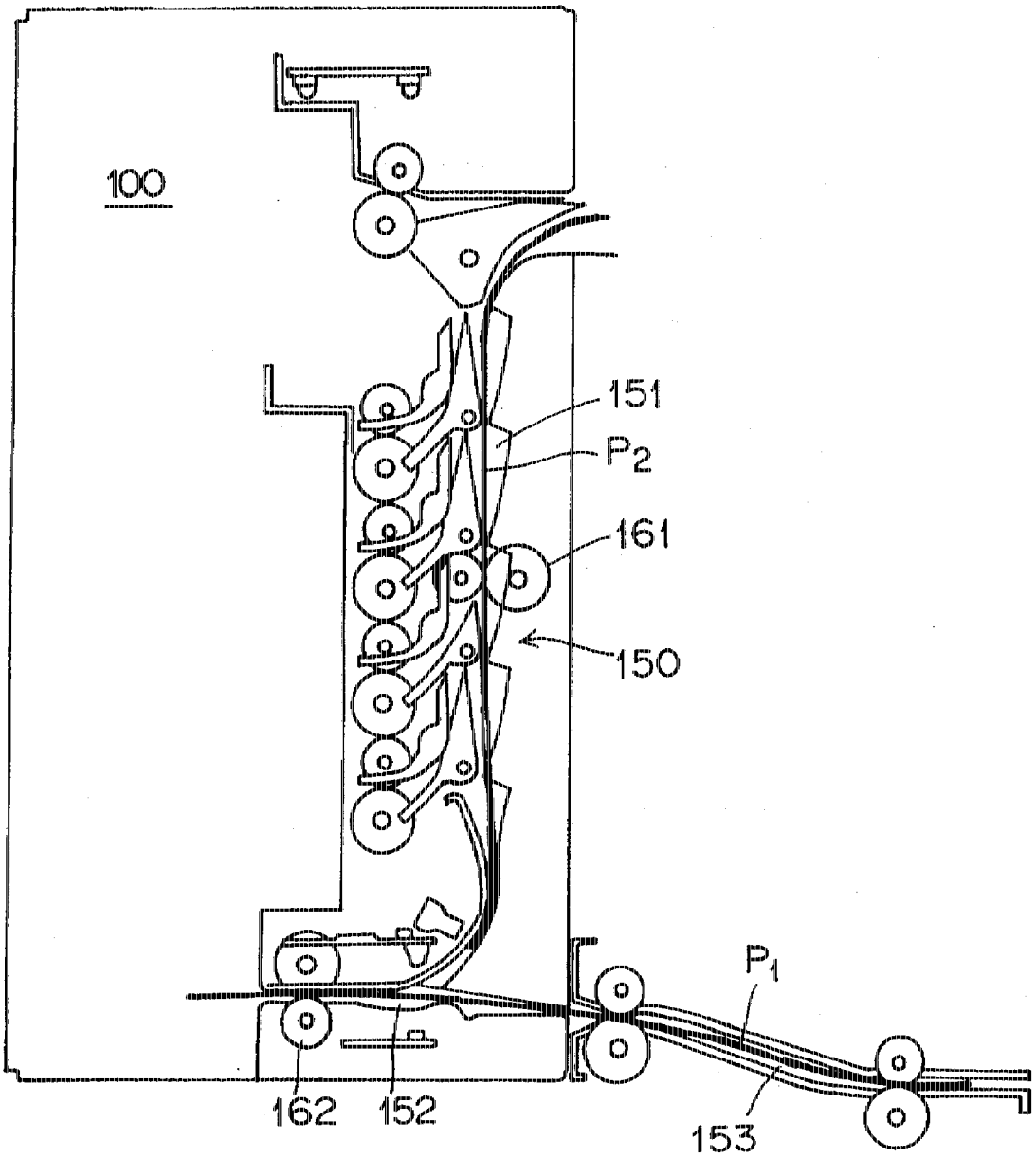
FIG. 8 is an illustration of the circulating section showing transportation of sheets.

The stand-by mode is to make the second sheet $P_2$ stand by in the vertical path 151 by stopping the vertical transport roller pair 161 while the trailing end portion of the first sheet $P_1$ is between the switchback roller pair 162 (see FIG. 8). Then, when the trailing edge of the first sheet $P_1$ is detected by the sensor SE8, the transportation of the second sheet $P_2$ is started again (see FIG. 9). The stand-by position of the second sheet $P_2$ can be set between a position where the leading edge of the sheet $P_2$ is detected by the sensor SE7 and a position where the leading edge of the sheet $P_2$ comes out of the resin sheet 156. This stand-by of the sheet is carried out by disconnecting the clutch of the vertical transport roller pair 161 to stop the roller pair 161 timed in accordance with a detection signal of the sensor SE7 or a detection signal of the sensor SE1 which is provided near the discharging roller pair 73 of the copying machine 10.

Figure 9:
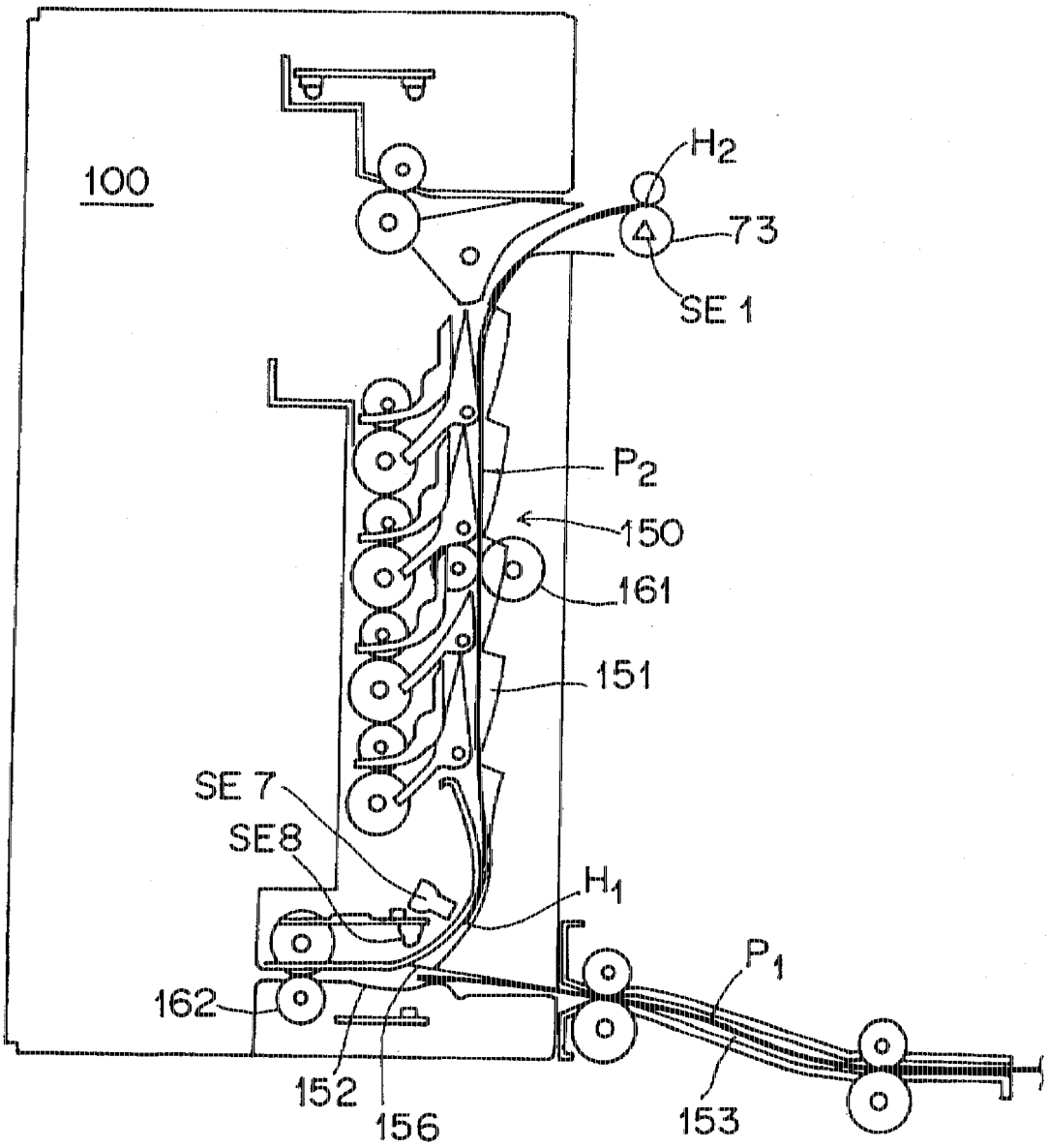
FIG. 9 is an illustration of the circulating section showing transportation of sheets.

When the trailing edge of the first sheet $P_1$ passes the detection point of the sensor SE8, the clutch of the vertical transport roller pair 161 is connected, whereby the second sheet $P_2$ which has been standing by in the vertical path 151 is transported to the switchback roller pair 162. Then, the sheet $P_2$ is switchbacked and transported to the horizontal path 153 by forward and reverse rotation of the switchback roller pair 162. As FIG. 9 shows, the distance between the leading edge $H_1$ of the sheet $P_2$ in the stand-by position and the nip portion $H_2$ of the discharging roller pair 73 is at least the length of the sheet $P_2$ in the transporting direction. In this embodiment, since the maximum size to be double-held around the transfer drum 51 is A4Y, the distance between $H_1$ and $H_2$ is at least 210 mm. However, if a clutch is provided to the discharging roller pair 73 in order to stop the discharging roller pair 73 arbitrarily, the distance between $H_1$ and the fixing roller pair 72 is at least 210 mm.

Figure 10:
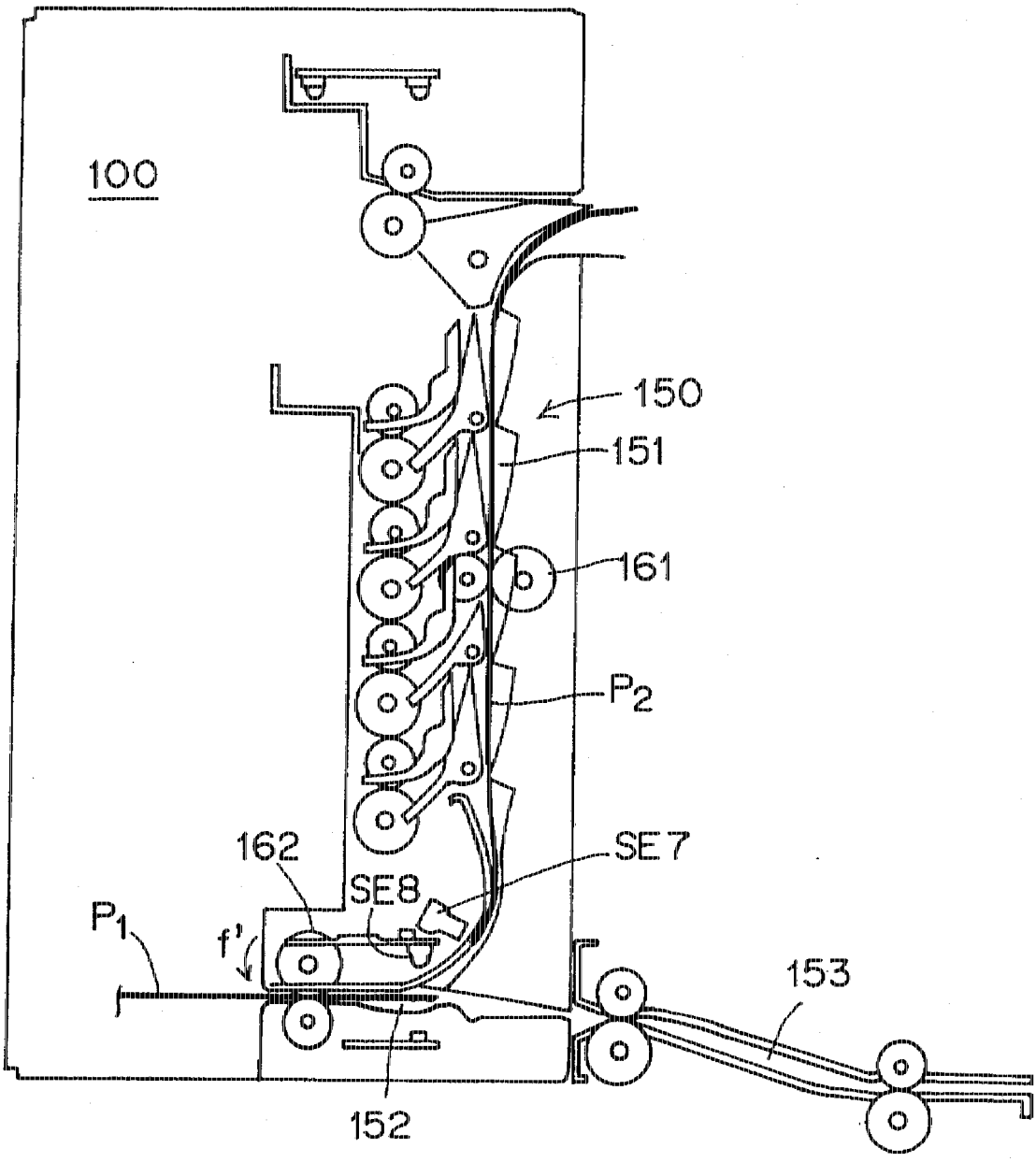
FIG. 10 is an illustration of the circulating section showing transportation of sheets.
Figure 11:
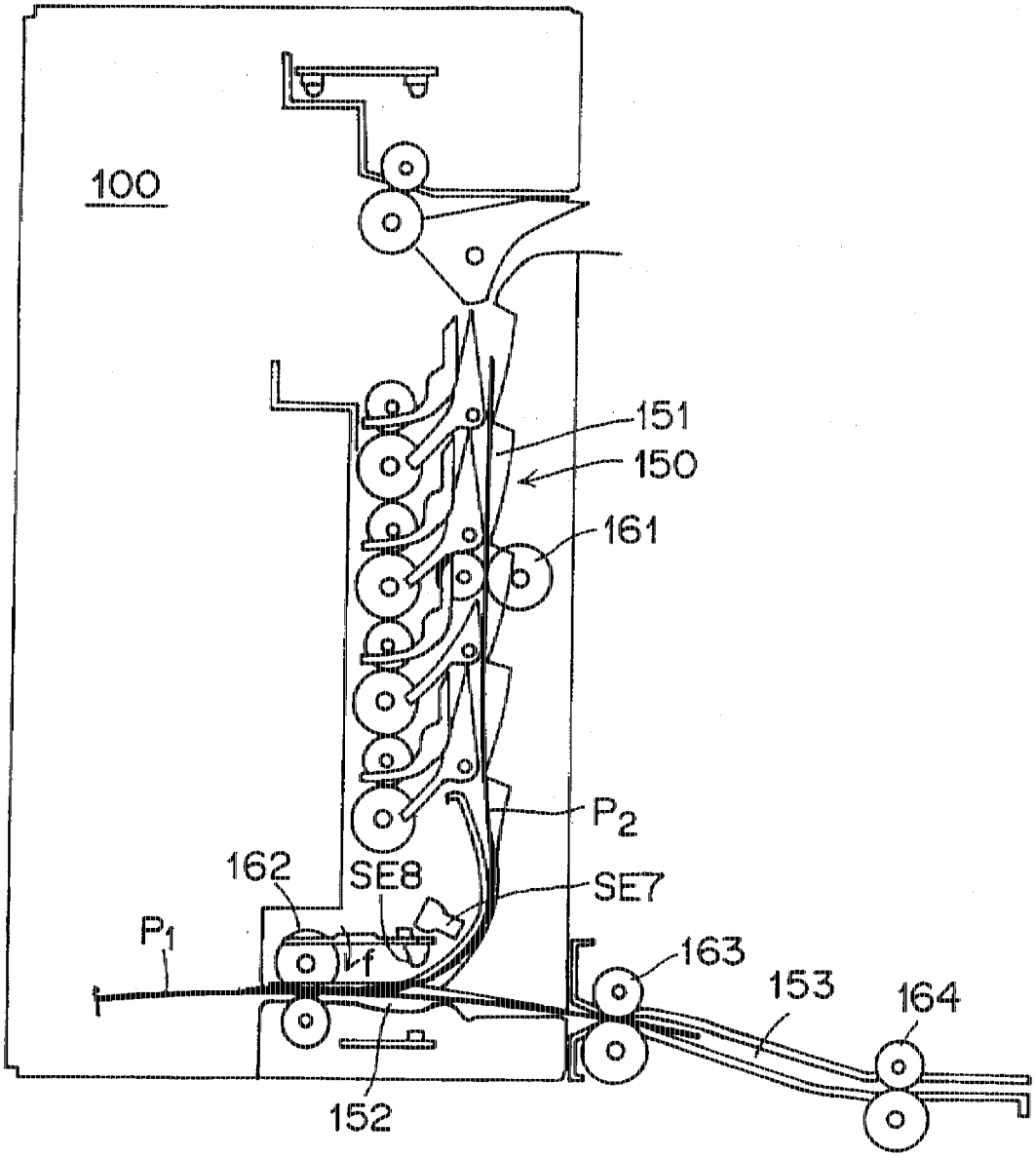
FIG. 11 is an illustration of the circulating section showing transportation of sheets.
Figure 12:
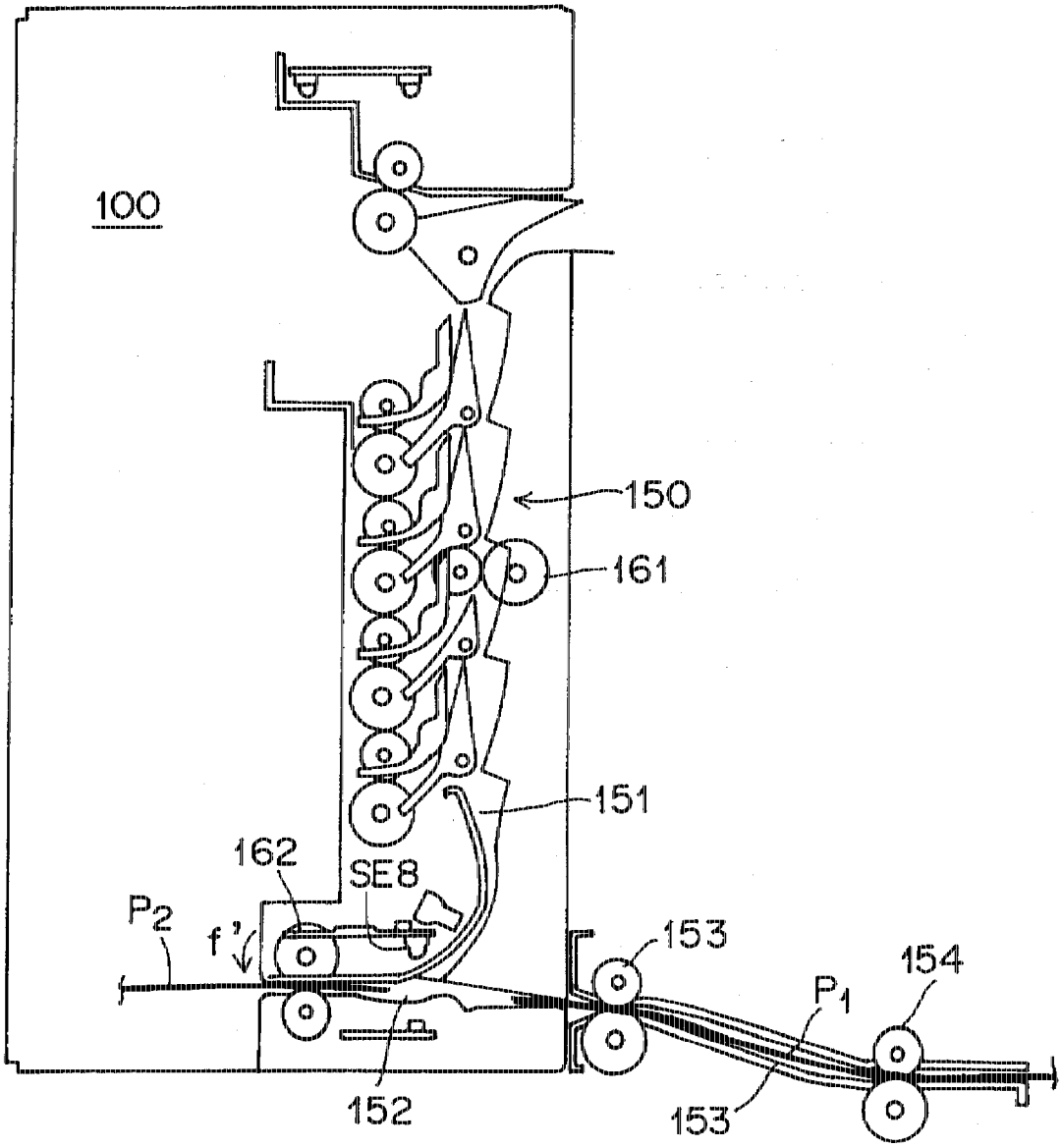
FIG. 12 is an illustration of the circulating section showing transportation of sheets.

In the pass-by mode, whether the trailing edge of the first sheet $P_1$ has passed the detection point of the sensor SE8 or not, the second sheet $P_2$ is transported into the switchback path 152 without standing by in the vertical path 151. As FIG. 10 shows, while the switchback roller pair 162 is rotated in reverse in the direction of arrow f' to transport the first sheet $P_1$ to the horizontal path 153, the second sheet $P_2$ comes near the switchback path 152. From the detection of the leading edge of the sheet $P_2$ by the sensor SE7, the time where the leading edge will come between the switchback roller pair 162 is expected, and immediately before that time, the switchback roller pair 162 is changed over to forward rotation in the direction of arrow f (see FIG. 11). In this moment, the leading end portion (at least 10 mm to 20 mm from the leading edge) of the first sheet $P_1$ is nipped by the refeeding roller pair 163, and in spite of the change-over of the switchback roller pair 162 to forward rotation, the sheet $P_1$ is transported to right in the horizontal path 153 by the force of the refeeding roller pair 163. Meanwhile, the leading edge of the second sheet $P_2$ comes between the switchback roller pair 162 which has been changed over to forward rotation, and the sheet $P_2$ is transported to left passing by the first sheet $P_1$. Then, after the trailing edge of the sheet $P_2$ is detected by the sensor SE8, the switchback roller pair 162 is changed over to reverse rotation in the direction of arrow f' (see FIG. 12), whereby the sheet $P_2$ is switchbacked and transported to the horizontal path 153.

In the stand-by mode, since the sheets $P_1$ and $P_2$ do not pass by each other, there is no fear that the quality of the images on the sheets $P_1$ and $P_2$ will be lowered by friction between the sheets $P_1$ and $P_2$. However, the stand-by mode takes a time for stand-by of the second sheet $P_2$, thereby lowering the copy productivity. On the other hand, the pass-by mode does not lower the copy productivity, but there is a fear that the quality of the images will be lowered by friction between the sheets $P_1$ and $P_2$. Therefore, it is preferred that the operator can select either the stand-by mode or the pass-by mode. It is also preferred that the system is so structured that the stand-by mode is automatically selected in full color copying and multicolor copying which require high picture quality. In the automatic selection, for example, the pass-by mode is automatically selected in copying using one color, and the stand-by mode is automatically selected in copying using two or more colors. With respect to selection of colors, the system may be so structured that the operator selects colors using an operation panel or that colors are determined from the result of color resolution of a document image carried out by the color CCD 26.

Further, when sheets to be copied on are thin paper or OHP paper, operation in the pass-by mode should be avoided. It is preferred to state this in the manual to instruct the operator to select the stand-by mode in such a case. Otherwise, input means for inputting the kind of sheets is provided, and when thin paper or OHP paper is used, the stand-by mode is automatically selected.

Next, copying is generally described especially focusing on feeding and refeeding.

When sheets of a large size (B5T, A4T, A3T or B4T) are used, the transfer drum 51 carries out single holding image transfer. FIG. 13 shows cases of single-side document/simplex copying, and the upper part of FIG. 13 shows cases of single holding image transfer. In using one color, every one rotation of the transfer drum 51, a sheet is fed from the feeding section 60. In using two colors, every two rotations of the transfer drum 51, a sheet is fed from the feeding section 60. A sheet is fed from the feeding section 60 every three rotations of the transfer drum 51 in using three colors, and every four rotations of the transfer drum 51 in using four colors. When sheets of a small size (A5Y, A4Y, A5T or B5T) are used, the transfer drum 51 carries out double holding image transfer. The lower part of FIG. 13 shows cases of single-side document/simplex copying by double holding image transfer. In using one color, every one rotation of the transfer drum 51, two sheets are fed from the feeding section 60. Two sheets are fed from the feeding section 60 every two rotations of the transfer drum 51 in using two colors, every three rotations of the transfer drum 51 in using three colors, and every four rotations of the transfer drum 51 in using four colors.

FIG. 14 shows cases of double-side document/duplex copying. In a case of single holding image transfer using one color, a sheet is fed from the feeding section 60 at a first rotation, and a next sheet is fed from the feeding section 60 at a second rotation of the transfer drum 51 for image formation on respective first sides of the sheets. Meanwhile, in the automatic document feeder 80, a double-side document fed from the feed stacker 81 passes over the document glass 19 and turns around the discharging/reversing roller 91, whereby the document is reversed and set on the document glass 19 with an even page facing down. Therefore, the image of the even page is copied on the first sides of the sheets. Then, the two sheets are transported into the duplex sorter 100 one by one. Each of the sheets is reversed by the sheet circulating section 150 and transported to the timing roller pair 65 with its first side facing up. Thereafter, the sheets are refed from the horizontal path 153 one by one at a fourth rotation and at a fifth rotation of the transfer drum 51. Before the refeeding, the double-side document is reversed again by the discharging/reversing roller 91 and set on the document glass 19 with an odd page facing down. Therefore, the image of the odd page is copied on the respective second sides of the sheets. The sheets which have obtained images on respective two sides are stored in specified ones of the bins 101 through 105.

In using two colors, sheets are fed from the feeding section 60 one by one at a first rotation and at a third rotation of the transfer drum 51, and are refed from the horizontal path 153 at a fifth rotation and at a seventh rotation of the transfer drum 51. In using three colors, sheets are fed from the feeding section 60 one by one at a first rotation and at a fourth rotation of the transfer drum 51, and are refed from the horizontal path 153 at a seventh rotation and at a tenth rotation of the transfer drum 51. In using four colors, sheets are fed from the feeding section 60 one by one at a first rotation and at a fifth rotation of the transfer drum 51, and are refed from the horizontal path 153 at a ninth rotation and at a thirteenth rotation of the transfer drum 51.

The lower part of FIG. 14 shows cases of double-side document/duplex copying by double holding image transfer. In using one color, sheets are fed from the feeding section 60 at a first rotation and at a third rotation of the transfer drum 51 two at a time for image transfer of an even page of a document onto respective first sides of the sheets. The total of four sheets are transported into the duplex sorter 100 successively two at a time and reversed by the vertical path 150. Then, the sheets are refed from the horizontal path 153 at a fourth rotation and at a sixth rotation of the transfer drum 51 successively two at a time. On respective second sides of the sheets, the image of an even page of the document is copied. In using two colors, sheets are fed from the feeding section 60 at a first rotation and at a third rotation of the transfer drum 51 two at a time, and are refed from the horizontal path 153 at a fifth rotation and at a seventh rotation of the transfer drum 51 two at a time. In using three colors, sheets are fed from the feeding section 60 at a first rotation and at a fourth rotation of the transfer drum 51 two at a time, and are refed from the horizontal path 153 at a seventh rotation and at a tenth rotation of the transfer drum 51 two at a time. In using four colors, sheets are fed from the feeding section 60 at a first rotation and at a fifth rotation of the transfer drum 51 two at a time, and are refed from the horizontal path 153 at a ninth rotation and at a thirteenth rotation of the transfer drum 51 two at a time.

The above-described feed/refeed patterns are in the pass-by mode. As mentioned, the duplex sorter 100 is operative also in the stand-by mode to avoid lowering of picture quality. FIG. 15 shows comparisons between feed/refeed patterns in the pass-by mode and those in the stand-by mode. FIG. 15 shows cases of duplex copying using one color. In a case of single holding and stand-by mode, a first sheet is fed from the feeding section 60 at a first rotation of the transfer drum 51 for image transfer onto a first side of the sheet and then transported into the circulating section 150. Further, the first sheet is refed from the horizontal path 153 at a third rotation of the transfer drum 51 for image transfer onto a second side of the sheet. A second sheet is fed from the feeding section 60 at a fifth rotation of the transfer drum 51 and refed from the horizontal path 153 at a seventh rotation of the transfer drum 51. Thus, in order to make two duplex copies by single holding image transfer, in the stand-by mode, the transfer drum 51 has to make seven rotations, while in the pass-by mode, the transfer drum 51 has to make five rotations. Accordingly, the pass-by mode results in high copy productivity.

As the lower part of FIG. 15 shows, in a case of double holding and stand-by mode, a first sheet and a second sheet are successively fed from the feeding section 60 at a first rotation of the transfer drum 51 for image transfer onto respective first sides of the sheets and transported into the circulating section 150. Further, the sheets are successively refed from the horizontal path 153 at a third rotation of the transfer drum for image transfer onto respective second sides of the sheets. A third sheet and a fourth sheet are successively fed from the feeding section 60 at a fifth rotation of the transfer drum 51 and are refed from the horizontal path 153 at a seventh rotation of the transfer drum 51. Thus, in order to make four duplex copies by double holding image transfer, in the stand-by mode, the transfer drum 51 has to make seven rotations, while in the pass-by mode, the transfer drum 51 has to make five rotations.

In the present embodiment, the capacity of the circulating section 150 is four small size (A4Y or smaller) sheets or two large size (A4T or larger) sheets. Therefore, in a case of double holding and pass-by mode, two sheets of a small size are fed from the feeding section 60 at a time.

In a case of one color and double holding, however, after a first sheet and a second sheet are fed at a first rotation of the transfer drum 51, the transfer drum 51 makes one idle rotation (second rotation). Then, a third sheet and a fourth sheet are fed at a third rotation of the transfer drum 51. Accordingly, the interval between the first sheet and the second sheet is small, and the interval between the second sheet and the third sheet is large. If the interval between the second and third sheets is equal to that between the first and second sheets, the sheets may collide with each other in the circulating section 150, thereby causing a paper jam. However, in the present embodiment, since the feed timing of the third sheet delays for one rotation of the transfer drum 51, the four sheets can be circulated without trouble, and duplex copying is efficiently carried out.

In the present embodiment, the number of times of reversion of a document is limited. For the purpose, the automatic document feeder 80 has a document reversion counter. In copying a double-side document, first, the document is reversed by the discharging/reversing roller 91 to subject its second side (even page) to copying. At that time, the document reversion counter is set to "1". The capacity of the circulating section 150 is four small size sheets (a case of double holding) or two large size sheets. Accordingly, the number of times of continuous scanning of one side of a document is limited to four when sheets of a small size are used and double holding is performed, and is limited to two when sheets of a large size are used. The number of times of scanning is recognized by a scan counter. When at most two times or four times of scanning of the second side (even page) is completed, the document is reversed again, and the document reversion counter is incremented. Then, a first side (odd page) of the document is copied. When scanning of the first side is completed, the value of the document reversion counter is compared with a limit, and the value of the scan counter is compared with the number of copies inputted by the operator. If the values of the counters do not come to numbers which meet respective conditions, the document is reversed and set on the document glass 19 again for copying of the second side of the document. After scanning of the second side, the document is further reversed and set on the document for copying of the first side. The document reversion counter is incremented every time the document is reversed. When the value of the scan counter comes to a number which is calculated from the number of copies inputted by the operator, the copying operation is completed. If the value of the document reversion counter comes to the limit, the copying operation is terminated, and an alarm is raised on the operation panel.

The reason why a limit is set on the number of times of reversion of a document is that unlimited repetitions of reversion of a document may damage the document especially when the document is thin paper. In the present embodiment, a number is selected from two different numbers and is set as the limit to the number of times of reversion of a document. The selection depends on the kind of the document, ordinary paper or thin paper, and the operator inputs information of thin paper. Table 1 shows the relationship between a required number of times of reversion of a document to make a desired number of copies T and the capacity M1 of the circulating section 150. However, since a limit M2 is set on the number of times of reversion of a document, the maximum number of copies which can be made in one copying operation (an operation carried out by one-push of a start key) is M1×M2/2. It is preferred that if T>M1×M2/2 when the operator inputs the number of copies, a display is made on the operation panel to instruct the operator to set the number of copies again. It is also preferred that the limit M2 can be set by the user. The limitation in a case of multiple copying will be described later referring to flow-charts.

TABLE 1

| (Number of Times of Reversion of a Document) | | | |
|---|---|---|---|
| Number of Copies | Capacity of Circulating Section M1 | | |
| T | 2 | 3 | 4 |
| 1 | 2 | 2 | 2 |
| 2 | 2 | 2 | 2 |
| 3 | 4 | 2 | 2 |
| 4 | 4 | 4 | 2 |
| 5 | 6 | 4 | 4 |
| 6 | 6 | 4 | 4 |
| 7 | 8 | 6 | 4 |
| 8 | 8 | 6 | 4 |
| 9 | 10 | 6 | 6 |
| 10 | 10 | 8 | 6 |
| 11 | 12 | 8 | 6 |
| . | | | |
| . | | | |
| . | | | |

Figure 16:
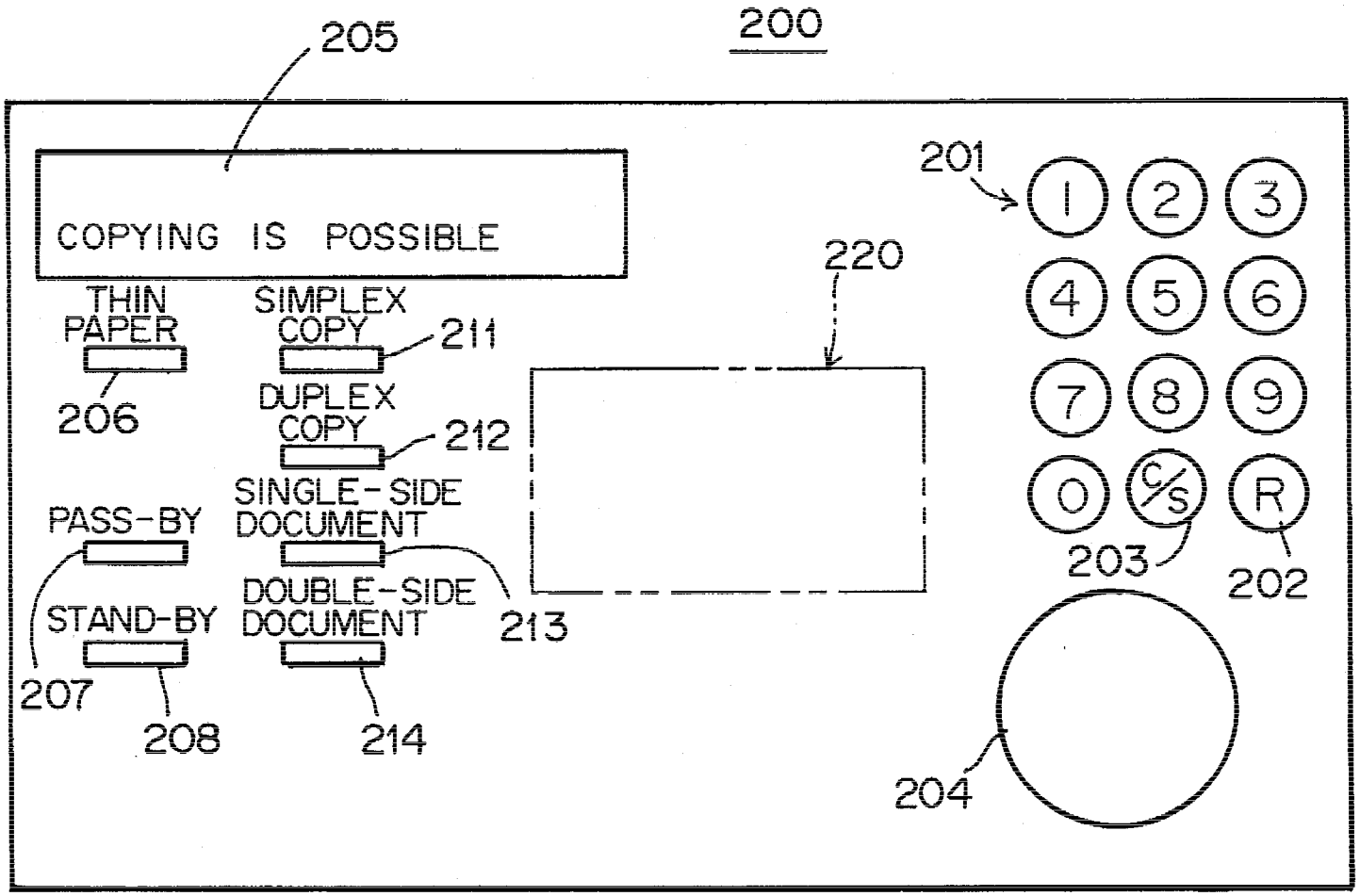
FIG. 16 is a plan view of an operation panel.

FIG. 16 shows the operation panel 200 provided on the copying machine 10. On the operation panel 200, there are provided a ten-key 201 for numerical setting of an copying operation such as setting of the number of copies to be made, a reset key 202 for initializing modes, a stop key 203 for stopping a copying operation, a start key 204 for starting a copying operation, a liquid crystal display 205 for displaying the condition of the copying system, a thin paper key 206 for inputting that the document is thin paper, a pass-by mode key 207 for setting the pass-by mode of the duplex sorter 100, a stand-by mode key 208 for setting the stand-by mode of the duplex sorter 100, a simplex copy mode key 211 for setting the simplex copy mode, a duplex copy mode key 212 for setting the duplex copy mode, a single-side document key 213 for inputting that the document has an image on one side, a double-side document key 214 for inputting that the document has an image on both sides, a color selecting section 220, etc.

Figure 17:
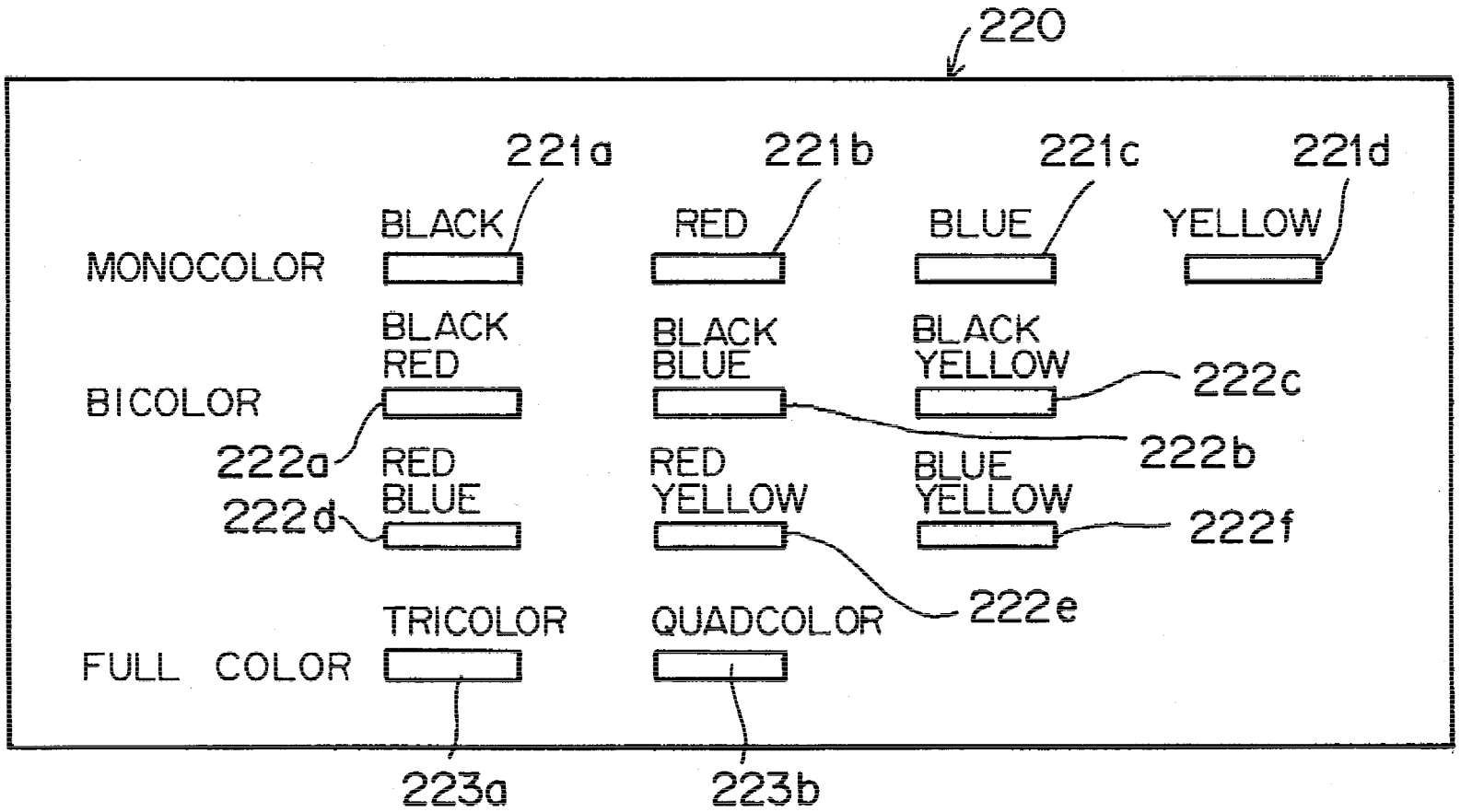
FIG. 17 is a plan view of a part of the operation panel.

As FIG. 17 shows, the color selecting section 220 has monocolor keys 221*a*, 221*b*, 221*c*, 221*d*, bicolor keys 222*a*, 222*b*, 222*c*, 222*d*, 222*e*, 222*f*, full color keys 223*a* and 223*b*.

Figure 18:
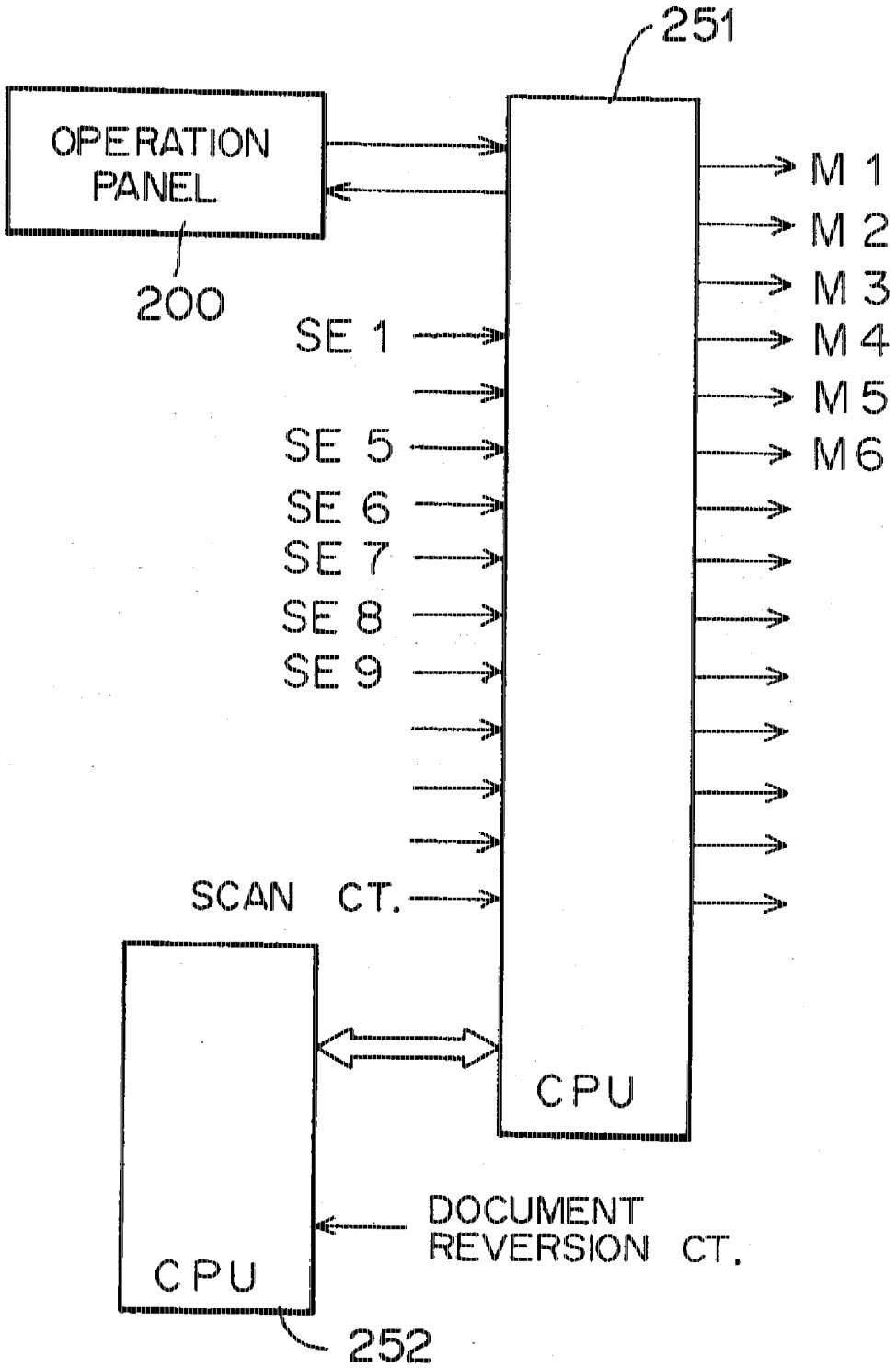
FIG. 18 is a block diagram of a control section of the copying system.

FIG. 18 shows a control section of the copying system. The main parts of the control section are a CPU 251 for controlling the copying machine 10 and the duplex sorter 100, and a CPU 252 for controlling the automatic document feeder 80. Each of the CPUs 251 and 252 has a built-in ROM and a built-in RAM. Signals from sensors and counters are inputted to the CPUs 251 and 252, and signals are sent to motors from the CPUs 251 and 252. The CPUs 251 and 252 communicate with each other.

An exemplary control procedure of the copying system is described referring to FIGS. 19 through 31.

In the following description, the term "on-edge" means a moment when a signal changes from off to on, and the term "off-edge" means a moment when a signal changes from on to off.

Figure 19:
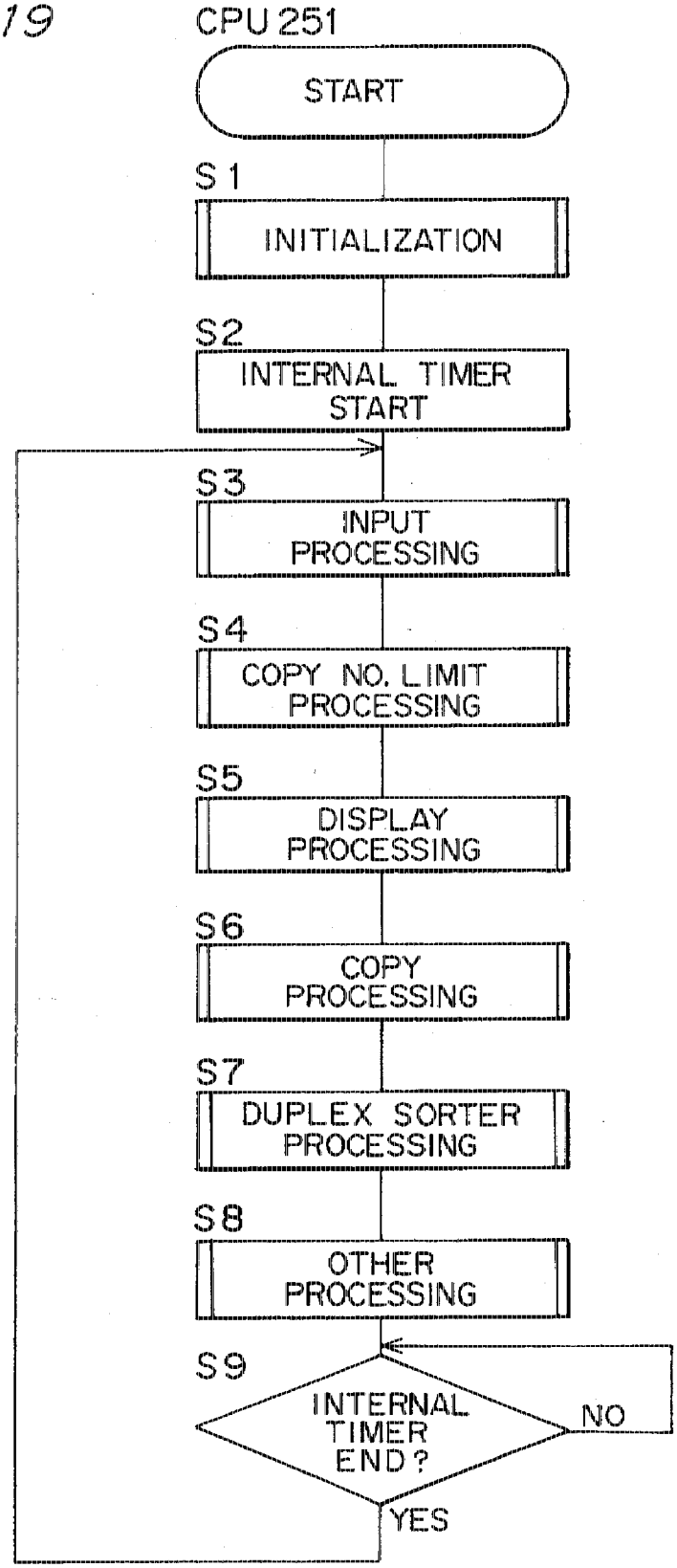
FIG. 19 is a flowchart which shows a main routine of a CPU.

FIG. 19 shows a main routine of the CPU 251. When the program starts, first at step S1, initialization is carried out. More specifically, the RAM is cleared, all the registers are reset, and all the devices and members are set to initial modes. At step S2, an internal timer is started. The internal timer is to determine a time for one routine of this main routine, and the timer value is set at step S1. Also, the internal timer is a reference of timers used in subroutines which will be described later.

Next, at steps S3 through S5, subroutines are called to carry out necessary processing. Then, the end of the internal timer is confirmed at step S9, and the program returns to step S2. Step S3 is to process information inputted with the operation panel 200. Step S4 is to process limitation of the number of copies. Step S5 is to process a display on the operation panel 200. Step S6 is to process a copying operation. Step S7 is to process an operation of the duplex sorter 100. Step S8 is to process other operations, such as temperature control of the fixing device 71, detection of a paper jam, etc.

Figure 20:
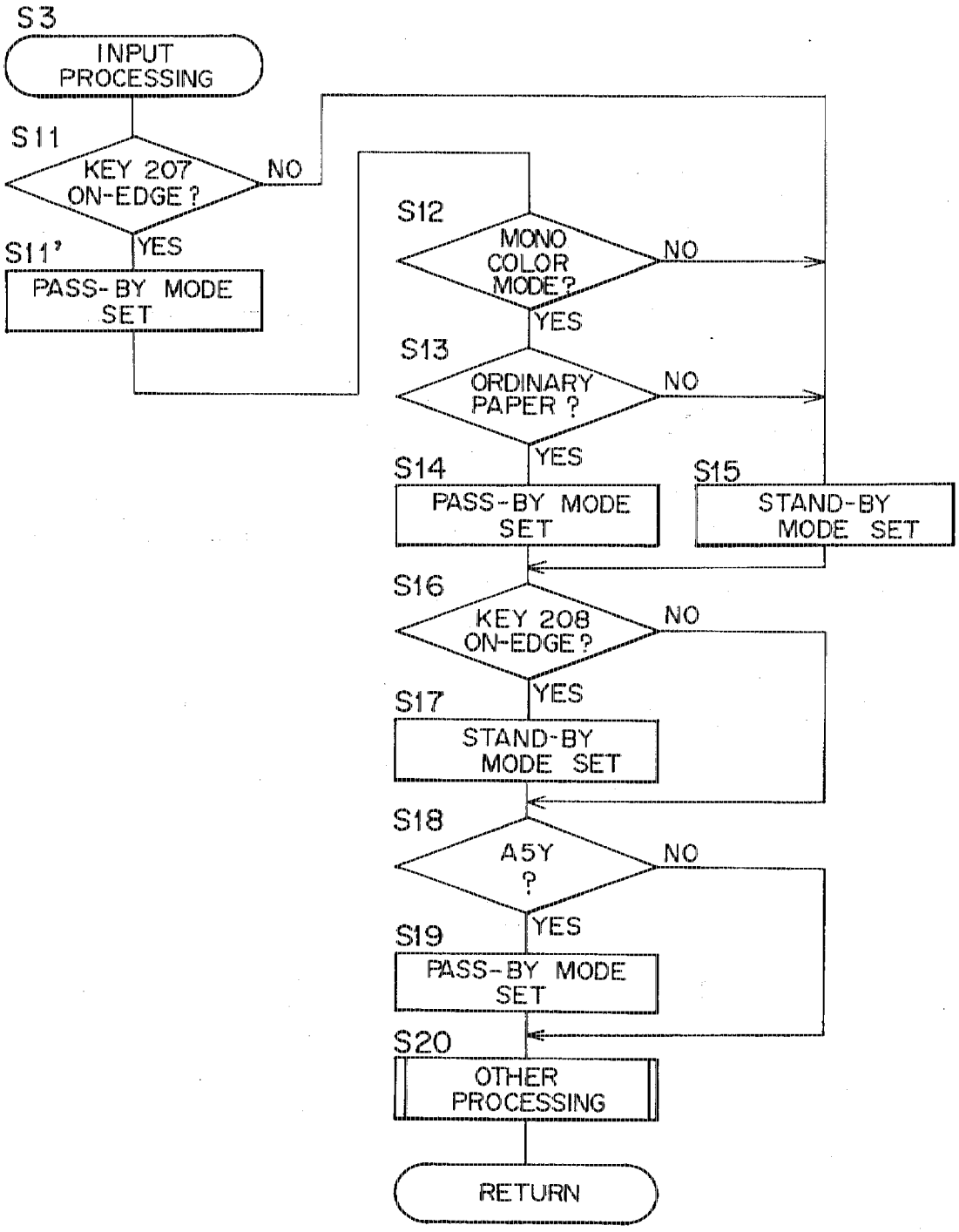
FIG. 20 is a flowchart which shows a subroutine for input processing.

FIG. 20 shows a subroutine for the input processing carried out at step S3 of the main routine.

First, at step S11, whether the pass-by mode key 207 is on-edge is judged. If the key 207 is on-edge, at step S11', the pass-by mode is set. Next, at step S12, whether any monocolor mode is selected is judged, and at step S13, whether sheets are ordinary paper is judged. If both the judgments at steps S12 and S13 are "YES", the pass-by mode is set at step S14. However, if at least one of the judgments at steps S12 and S13 is "NO", the stand-by mode is set at step S15. In this way, although the operator has pressed the key 207 to select the pass-by mode, if a bicolor or a full color mode is selected or if sheets are thin paper, the stand-by mode is automatically set to prevent lowering of picture quality of copies and trouble in transporting sheets.

On the other hand, if an on-edge of the stand-by mode key 218 is judged at step S16, the stand-by mode is set at step S17. The system follows the operator's intention to put a priority on the picture quality.

Next, at step S18, whether the size of sheets is A5Y is judged. If "YES", the pass-by mode is set at step S19. In this case, because the sheets are small, even if the duplex sorter 100 is operated in the pass-by mode, practically the sheets will be transported without passing by each other. At step S20, other input processing is carried out.

Figure 21:
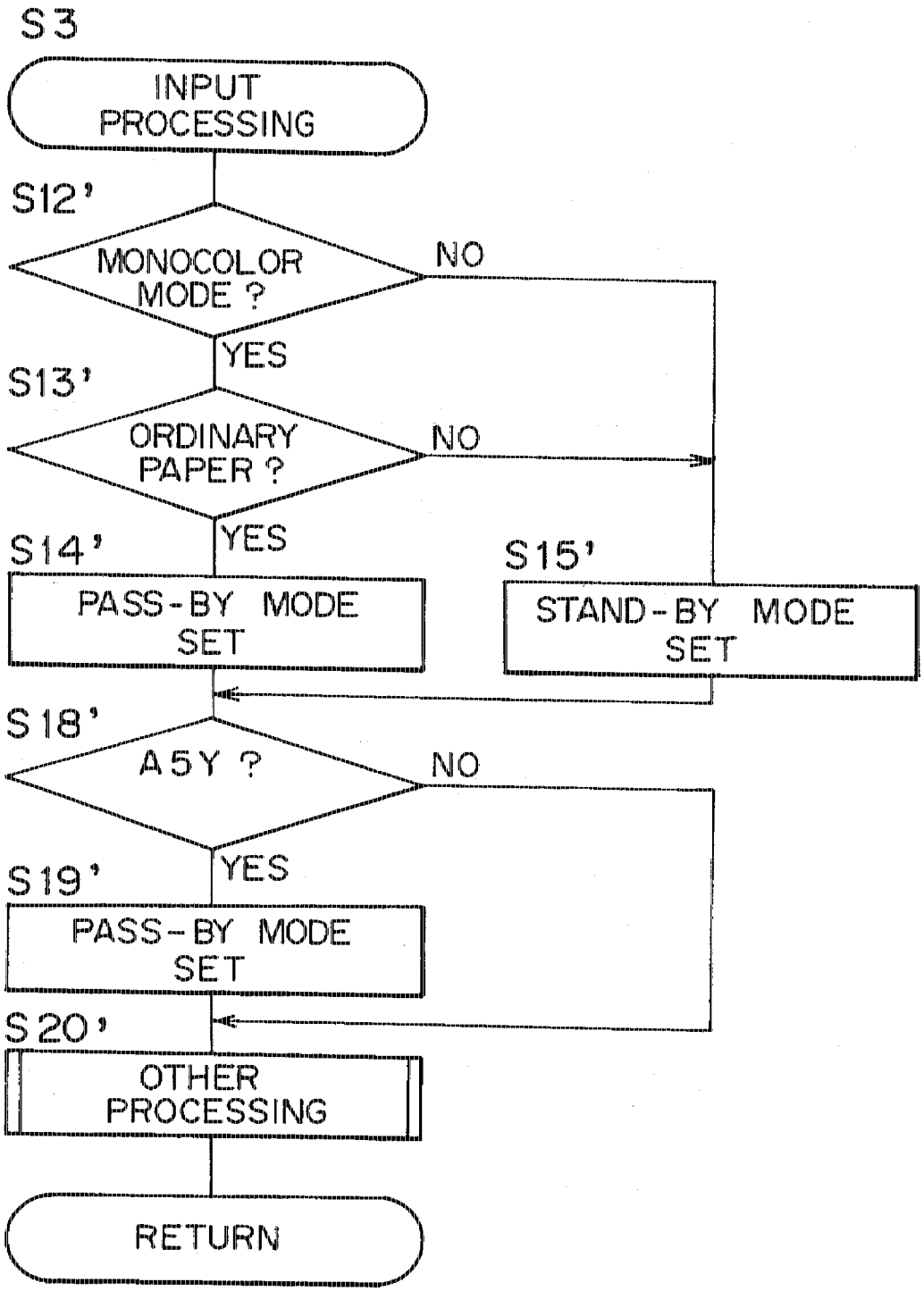
FIG. 21 is a flowchart which shows a modified subroutine for input processing.
Figure 22A:
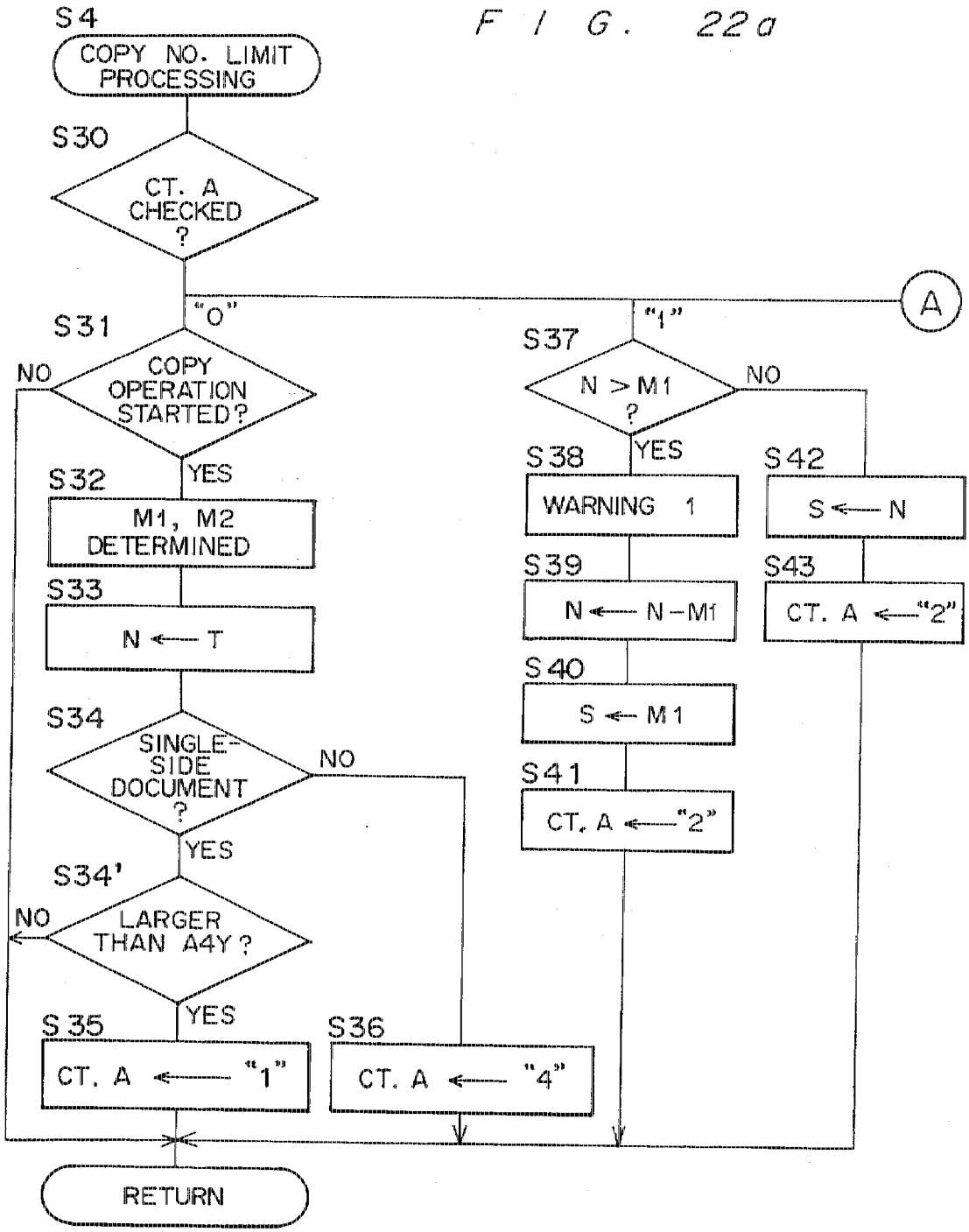
FIGS. 22*a* through 22*d* are flowcharts which show a subroutine for copy number limit processing.
Figure 22B:
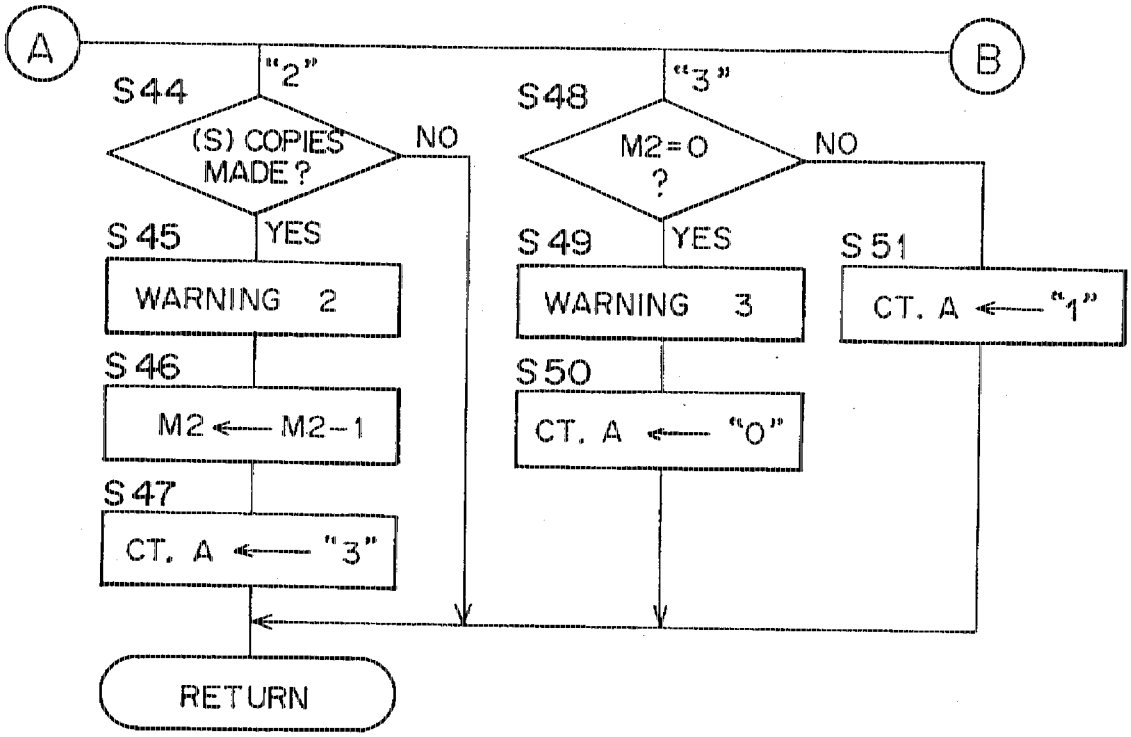
Figure 22C:
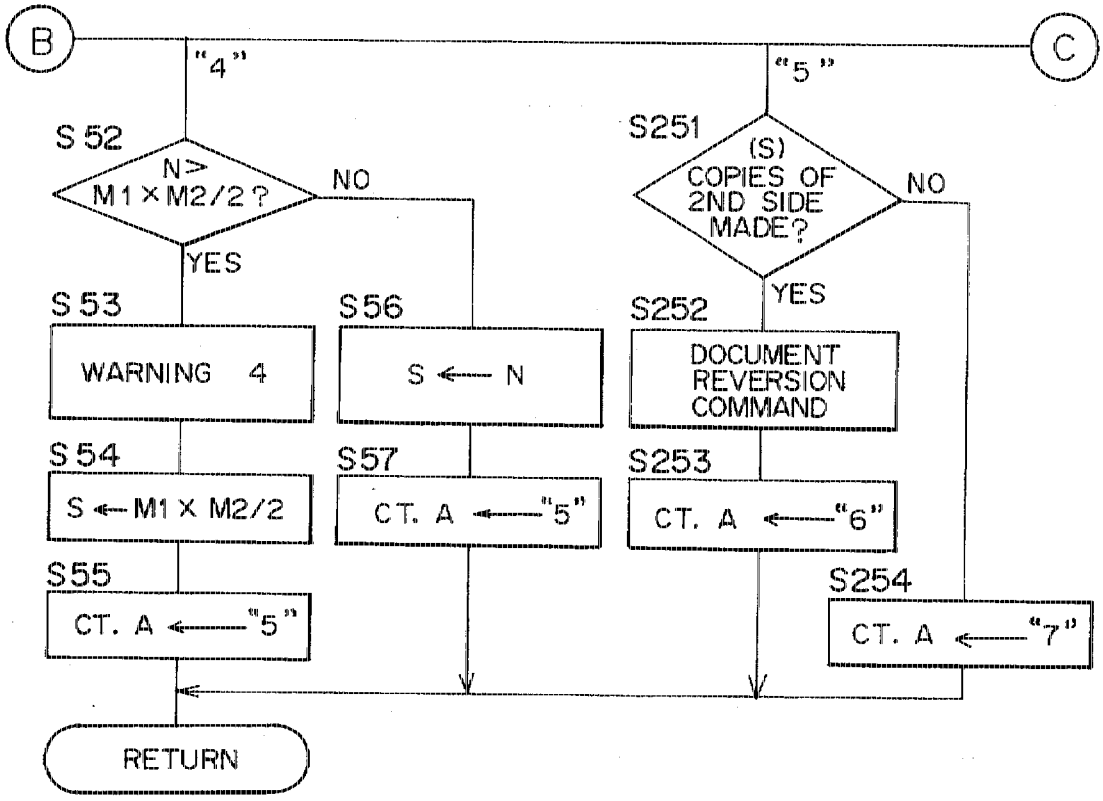
Figure 22D:
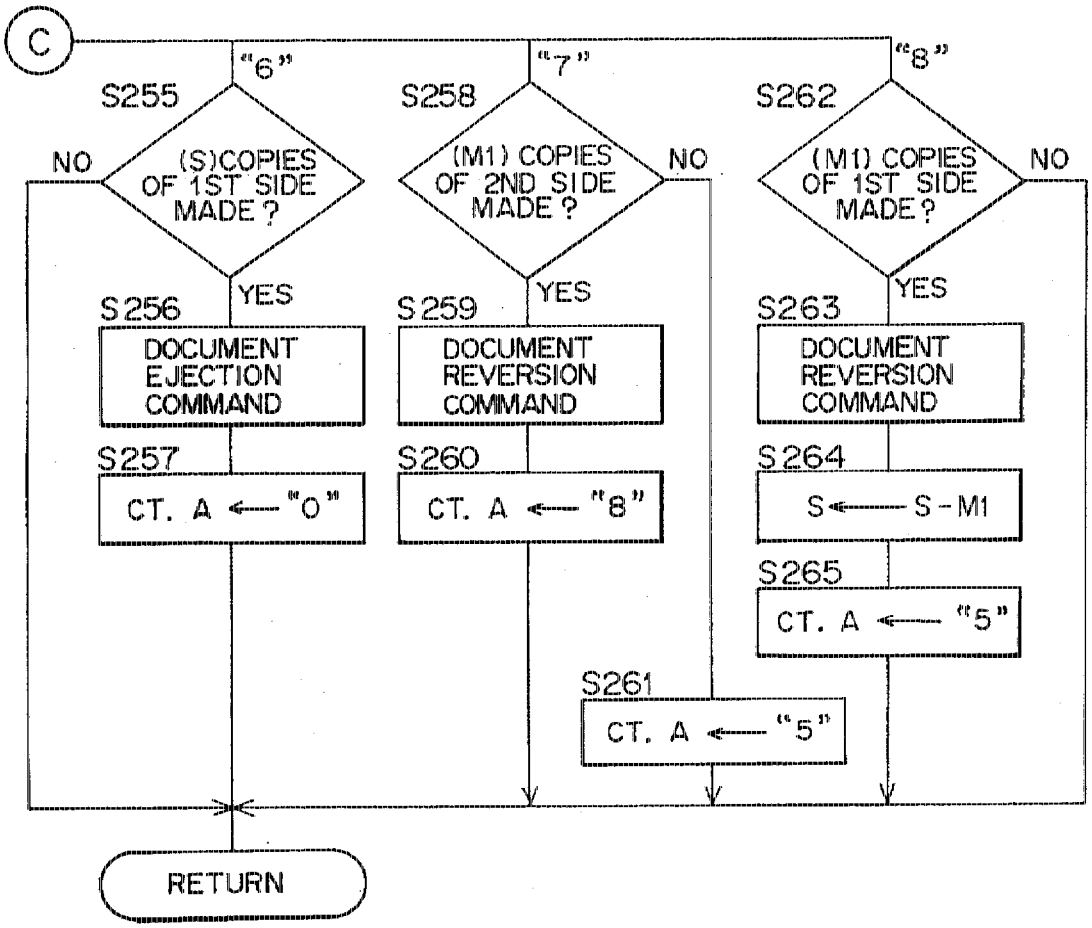

FIG. 21 shows a modification of the input processing subroutine carried out at step S3. In this modified case, neither the pass-by mode key 207 nor the stand-by mode key 208 are provided on the operation panel 200. If a monocolor mode is selected and if the sheets are ordinary paper ("YES" at steps S12' and S13' ), the pass-by mode is automatically set at step S14'. If a bicolor or a full color mode is selected or if the sheets are thin paper, the stand-by mode is automatically set at step S15'. Further, as in the sub-routine of FIG. 20, if the size of sheets is A5Y ("YES" at step S15' ), the pass-by mode is set at step S19'.

FIGS. 22*a* through 22*d* show a subroutine for the copy number limit processing carried out at step S4 of the main routine. This subroutine is carried out when the duplex copy mode is selected, whether the single-side document mode or the double-side document mode. When the duplex mode is set in the input processing subroutine shown by FIG. 20 or FIG. 21, this subroutine is carried out. In this subroutine, a state counter A is checked at step S30, and the processing proceeds according to the value of the state counter A (initial value is "0").

When the state counter A is "0", a start of a copying operation is checked at step S31. When a copying operation has started, the variables M1 and M2 are determined at step S32. The variable M1 is the number of sheets which can be contained in the circulating section 150 and depends on the kind of copy mode and the size of sheets. The variable M1 is determined referring to Table 2. The variable M2 is the limit to the number of times of reversion of a document and is determined depending on the kind of the document. The variable M2 is determined referring to Table 3.

Since the document glass 19 has a size sufficiently to bear a sheet of A3T size, the automatic document feeder 80 can set two sheets of a small size (A4Y or smaller) side by side on the document glass 19 (double-feed mode). Therefore, single-side documents of a small size can be subjected to duplex copying. More specifically, two documents are set on the document glass 19 side by side by the double-feed and are copied on two sides of a sheet respectively by a so-called book-divide copying. In this case, the number of copies to be made is not limited. However, if the documents are larger than A4Y, the double-feed is impossible, and the number of copies to be made is limited with respect to the variable M1. Further, the documents have to be set onto and discharged from the document glass 19 many times to make a large number of copies, and the documents may be damaged. In order to avoid this trouble, in this case, the number of copies is limited also with respect to the variable M2. In this case, the variable M2 means the number of times of setting each document on the document glass 19.

TABLE 2

(Value of M1)

| Copy Mode | | | Size of Sheets | | |
|---|---|---|---|---|---|
| | | | | B5Y | B5T A4T |
| Image Transfer | Color | Sheet Transportation | A5Y | A5T A4Y | B4T A3T |
| Single Holding | Monocolor | Pass-by | 2 | 2 | 2 |
| | | Stand-by | 2 | 1 | 1 |
| | Bicolor or Full color | | 2 | 2 | 2 |
| Double Holding | Monocolor | Pass-by | 4 | 4 | |
| | | Stand-by | 4 | 2 | |
| | Bicolor or Full color | | 4 | 4 | |

TABLE 3

(Value of M2)

| Kind of Document | | Size of Documents | |
|---|---|---|---|
| | | A5Y B5Y A5T A4Y | B5T A4T B4T A3T |
| Single-side | Thin Paper | No Limit | 6 |
| | Ordinary Paper | No Limit | 12 |
| Double-side | Thin Paper | 6 | 6 |
| | Ordinary Paper | 12 | 12 |

Next, at step S33, the number of copies T inputted by the operator is set in a counter N for counting the rest of copies to be made. At step S34, whether single-side documents are to be copied is judged. If a double-side document is to be copied, the state counter A is set to "4" at step S36. If single-side documents are to be copied, at step S34', whether the size of the documents is larger than A4Y is judged. If the size is not larger than A4Y, the double-feed mode is possible, and the number of copies is unlimited. Therefore, this subroutine is completed. On the other hand, if single-side documents of a size larger than A4Y are to be copied, the state counter A is set to "1" at step S35.

When the state counter A is "1", whether the value of the counter N is larger than the value M1 is judged at step S37. If "YES", at step S38, a warning 1 is displayed on the operation panel 200. The warning 1 is a display indicating that the designated number of copies cannot be made in one operation and that the documents have to be set again after completion of an operation. Next, a value (N−M1) is set in the counter N at step S39, and the value M1 is set in a counter S at step S40. The counter S indicates the number of copies which can be made without the operator's setting the documents on the stacker 81 again. Then, at step S41, the state counter A is set to "2".

On the other hand, if the value of the counter N is not larger than the value M1 ("NO" at step S37), the same value as the counter N (number of copies inputted by the operator) is set in the counter S at step S42. Then, the state counter A is set to "2".

When the state counter A is "2", at step S44, whether the number of copies indicated by the counter S has been made is judged. If "YES", a warning 2 is displayed on the operation panel 200 at step S45. The warning 2 is a display indicating that the documents have to be set on the stacker 81 again. Next, the variable M2 is renewed to a value (M2−1) at step S46, and the state counter A is set to "3" at step S47.

When the state counter A is "3", at step S48, whether the variable M2 is zero is judged. If the variable M2 is not zero, the state counter A is set to "1" at step S51. If the variable M2 is zero, at step S49, a warning 3 is displayed on the operation panel 200. The warning 3 is a display indicating that further multiple copying is impossible because it may damage the documents. Then, the state counter A is reset to "0" at step S50.

When the state counter A is "4", at step S52, whether the value of the counter N is larger than a value (M1×M2/2) is judged. If "YES", at step S53, a warning 4 is displayed on the operation panel 200. The warning 4 is a display indicating that multiple copying over (M1×M2/2) copies is impossible because it may damage the document and that multiple copying for (M1×M2/2) copies is carried out. Next, the value (M1×M2/2) is set in the counter S at step S54, and the state counter A is set to "5" at step S55.

On the other hand, the value of the counter N is not larger than the value (M1×M2/2) ("NO" at step S52), the same value as the counter N (number of copies inputted by the operator) is set in the counter S at step S56, and the state counter A is set to "5" at step S57.

When the state counter A is "5", whether copying of the second side of the document to make the number of copies indicated by the counter S is completed is judged at step S251. If the copying is completed, a command for reversion of the document is sent to the CPU 252 at step S252, and the state counter A is set to "6" at step S253. If the copying is not completed at step S251, the state counter A is set to "7" at step S254.

When the state counter A is "6", at step S252, whether copying of the first side of the document to make the number of copies indicated by the counter S is completed is judged. When the copying is completed, a command for ejection of the document is sent to the CPU 252 at step S256, and the state counter A is reset to "0" at step S257.

When the state counter A is "7", at step S258, whether copying of the second side of the document to make the number of copies indicated by the value M1 is completed is judged. If the copying is completed, a command for reversion of the document is sent to the CPU 252 at step S259, and the state counter A is set to "8" at step S260. If the copying is not completed at step S258, the state counter A is set to "5" at step S261.

When the state counter A is "8", at step S262, whether copying of the first side of the document to make the number of copies indicated by the value M1 is completed is judged. When the copying is completed, a command for reversion of the document is sent to the CPU 252 at step S263. Then, the value M1 is subtracted from the value of the counter S at step S264, and the state counter A is set to "5" at step S265.

Figure 23:
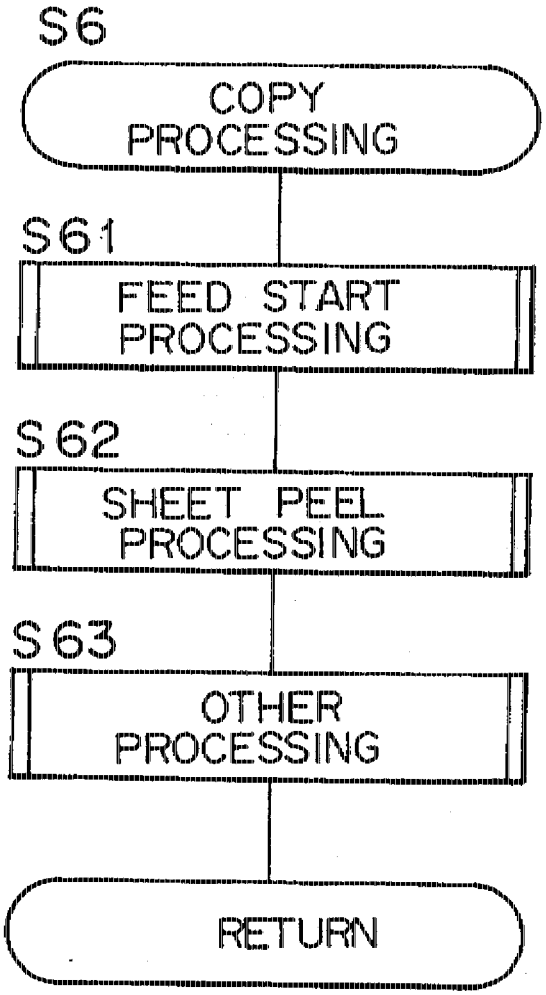
FIG. 23 is a flowchart which shows a subroutine for copy processing.

FIG. 23 shows a subroutine for the copy processing carried out at step S6 of the main routine. First at step S61, processing for starting a sheet feed is carried out. Next, at step S62, processing for peeling a sheet off the transfer drum 51 is carried out, and at step S63, other copy processing is carried out.

Figure 24:
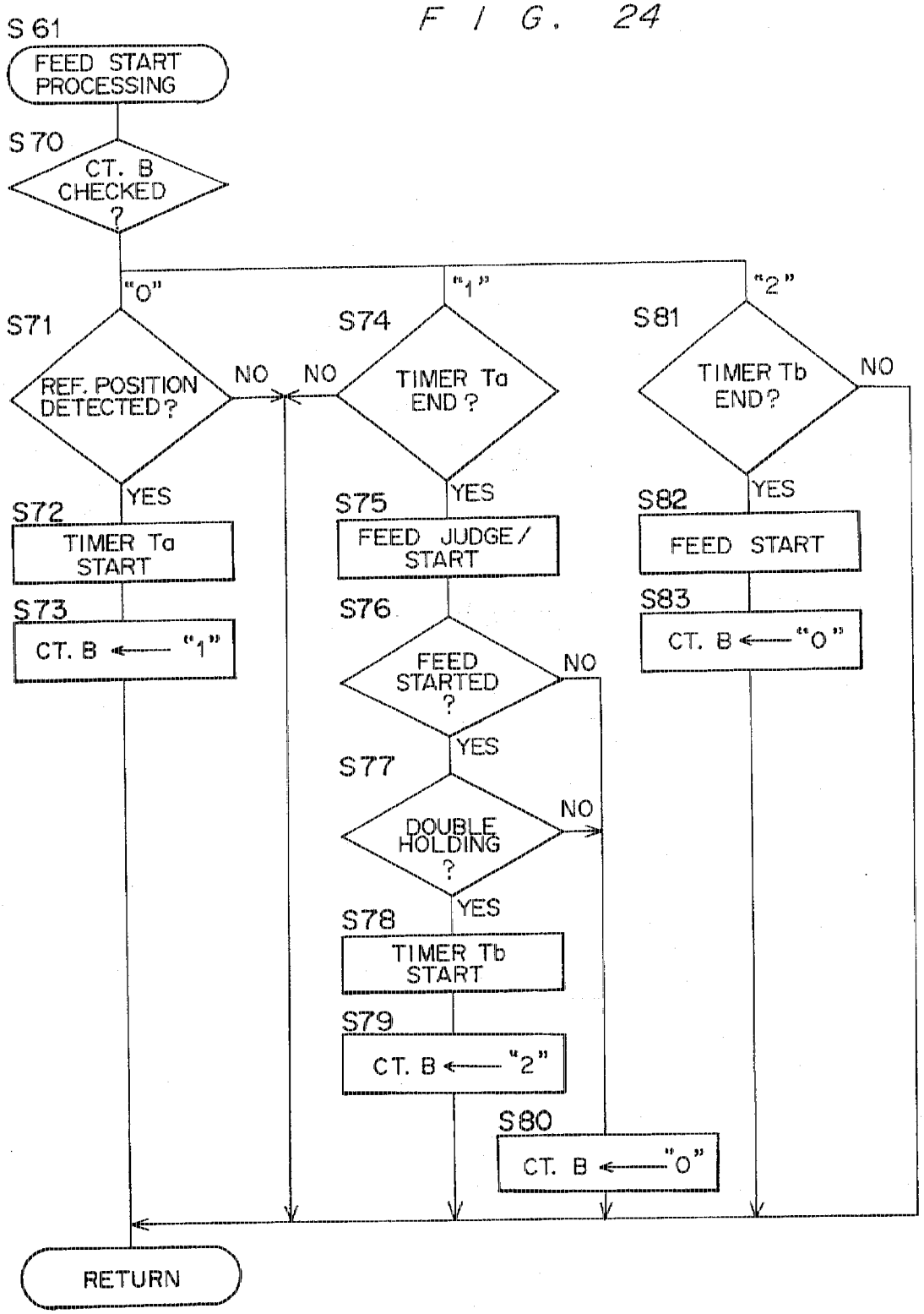
FIG. 24 is a flowchart which shows a subroutine for feed start processing.

FIG. 24 shows a subroutine for the feed start processing carried out at step S61. In this subroutine, the value of a state counter B (initial value is "0") is checked at step S70, and the processing proceeds according to the value.

When the state counter B is "0", the reference position of the transfer drum 51 which is rotating in the direction of arrow c is detected at step S71. Then, a timer Ta is started at step S72, and the state counter B is set to "1" at step S73. The timer Ta is to time a feed of a sheet from the moment when the reference position of the transfer drum 51 is detected. When the state counter B is "1", the end of the timer Ta is confirmed at step S74. Then, at step S75, whether to feed a sheet (with reference to FIGS. 13, 14 and 15) is judged, and if it is a rotation at which a sheet feed must be carried out, feeding is started. Next, a start of the sheet feed is confirmed at step S76, and whether double holding should be carried out is judged at step S77. If "YES", a timer Tb is started at step S78, and the state counter B is set to "2" at step S79. The timer Tb is to time a feed of a second sheet. On the other hand, if single holding should be carried out, the state counter B is reset to "0" at step S80.

When the state counter B is "2", the end of the timer Tb is confirmed at step S81. Then, a feed of the second sheet is started at step S82, and the state counter B is reset to "0" at step S83.

Figure 25:
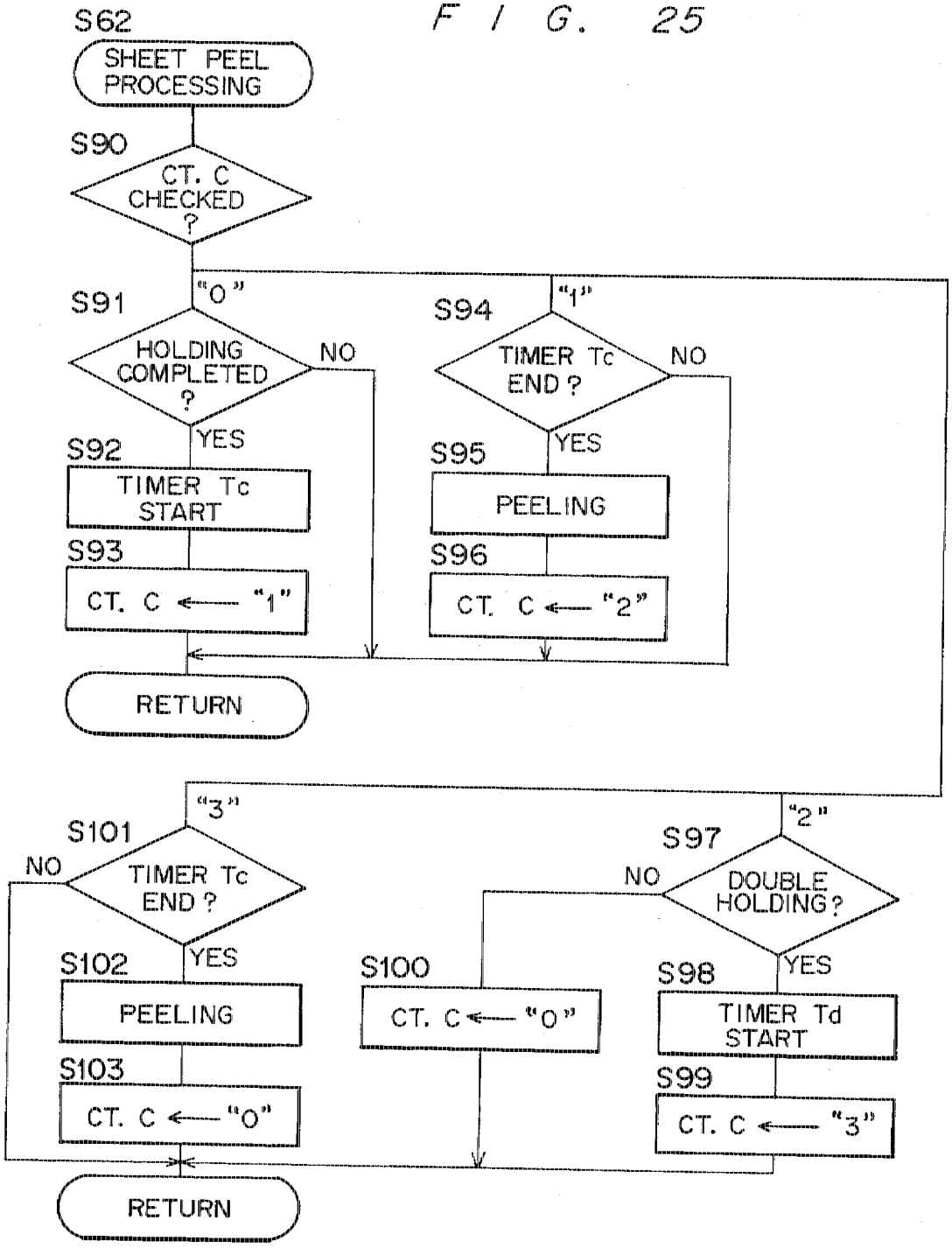
FIG. 25 is a flowchart which shows a subroutine for sheet peel processing.

FIG. 25 shows a subroutine for the sheet peel processing carried out at step S62. In this subroutine, the value of a state counter C (initial value is "0" ) is checked at step S90, and the processing proceeds according to the value.

When the state counter C is "0", completion of holding a sheet on the transfer drum 51 is confirmed at step S91. Then, a timer Tc is started at step S92, and the state counter C is set to "1" at step S93. The timer Tc is to time peeling of the sheet, of which timing depends on the number of colors used for copying (see Table 4).

When the state counter C is "1", the end of the timer Tc is confirmed at step S94, and the sheet is peeled off the transfer drum 51 at step S95. More specifically, the chargers **56*a* and 56*b* are turned on to weaken the attraction of the transfer drum 51 applied to the sheet, and the sheet is peeled off the transfer drum 51 by the peeling claw 52. Then, the state counter C is set to "2" at step S96**.

When the state counter C is "2", whether the transfer drum 51 has performed double holding is Judged at step S97. If "YES", a timer Td is started at step S98, and the state counter C is set to "3" at step S99. The timer Td is to time peeling of the second sheet. On the other hand, if the transfer drum 51 has performed single holding, the state counter C is reset to "0" at step S100.

When the state counter C is "3", the end of the timer Td is confirmed at step S101, and the second sheet is peeled off the transfer drum 51 at step S102 in the same manner as step S95. Then, the state counter C is reset to "0" at step S103.

TABLE 4

| Number of Colors | Time in the Timer Tc |
|---|---|
| 1 | half rotation of transfer drum |
| 2 | one and a half rotations of transfer drum |
| 3 | two and a half rotations of transfer drum |
| 4 | three and a half rotations of transfer drum |

Figure 26:
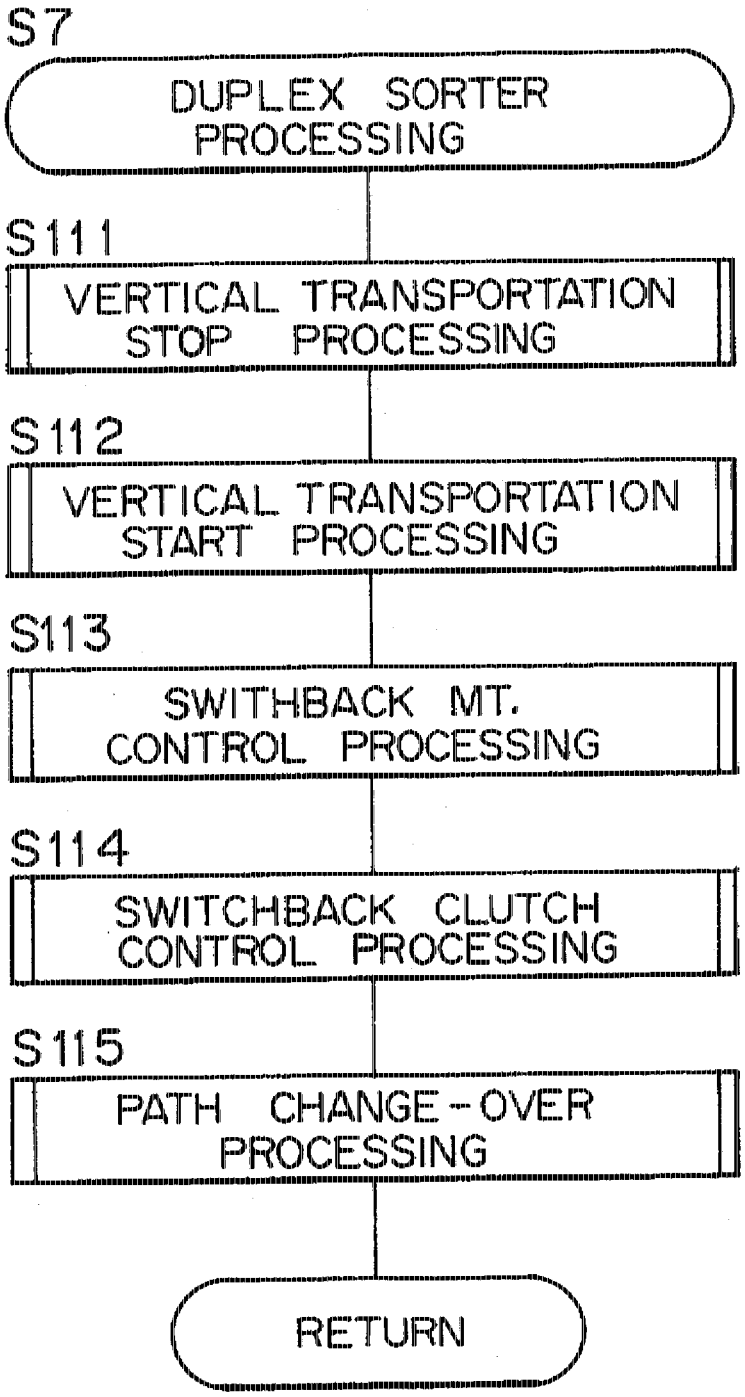
FIG. 26 is a flowchart which shows a subroutine for duplex sorter control processing.

FIG. 26 shows a subroutine for the duplex sorter processing carried out at step S7 of the main routine. In this subroutine, first at step S111, processing for stopping a sheet in the vertical path 151 is carried out. Next, processing for turning on and off the switchback motor M5 is carried out at step S113; processing for controlling the connection between the motor M5 and the switchback roller pair 162 is carried out at step S114; and processing for change over the path in the duplex sorter 100 is carried out at step S115.

Figure 27:
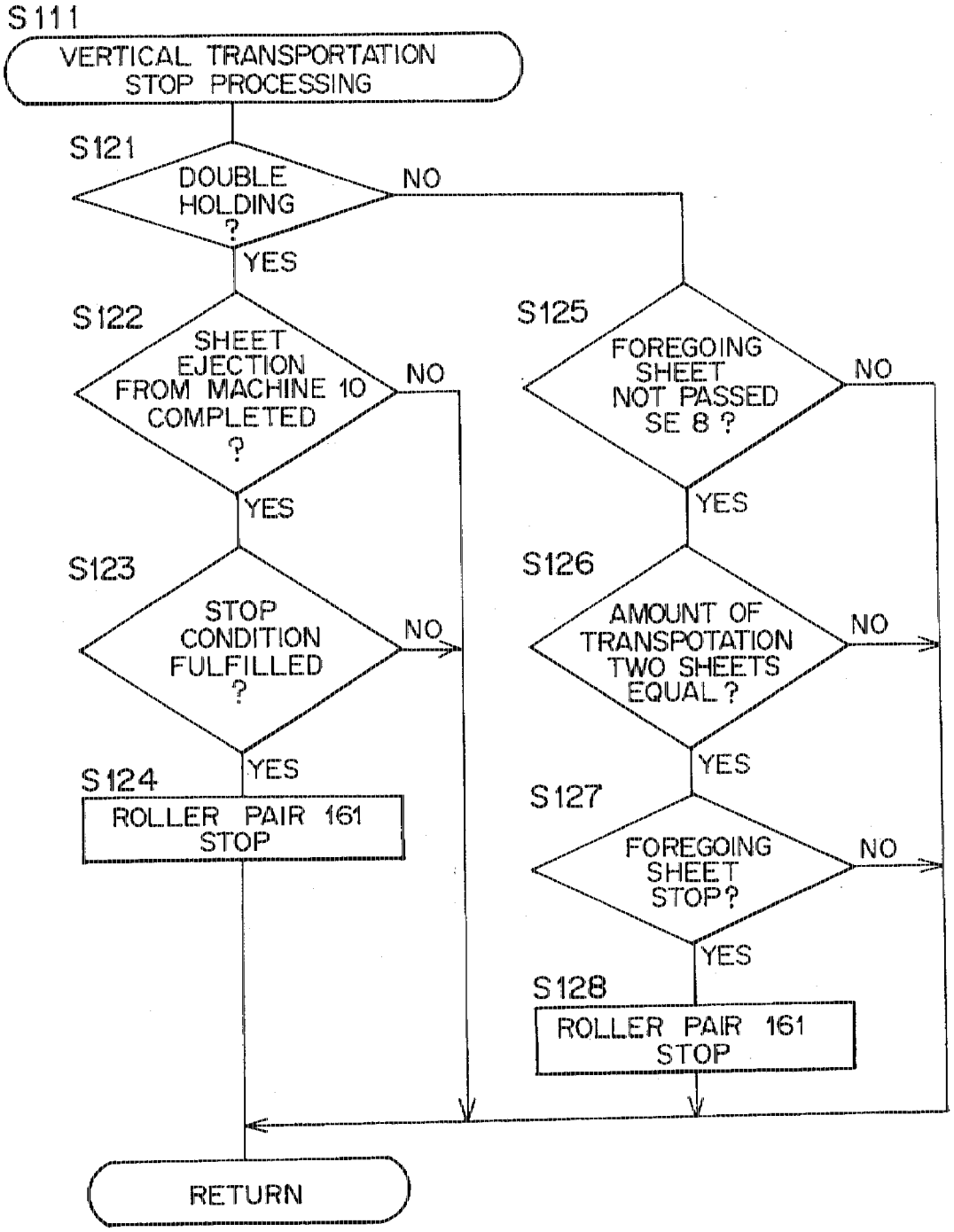
FIG. 27 is a flowchart which shows a subroutine for vertical transportation stop processing.

FIG. 27 shows a subroutine for the vertical transportation stop processing carried out at step Sill. This subroutine is to temporarily stop a sheet being transported in the vertical path 151.

First at step S121, whether the transfer drum 51 has performed double holding is judged. If "YES", at step S122, whether a sheet has been transported by a specified amount since the sheet passed through the discharging roller pair 73 is judged. The specified amount is an amount by which the sheet is certainly nipped between the vertical transport roller pair 161 after passing through the discharging roller pair 73, and this amount depends on the sheet size. When the sheet is transported by the specified amount, at step S123, whether the condition shown by Tables 5a and 5b is fulfilled is judged. If the condition is fulfilled, the vertical transport roller pair 161 is stopped at step S124.

On the other hand, if the transfer drum 51 has performed single holding, ("NO" at step S121), it is confirmed at step S125 that a foregoing sheet, after making a switchback, has not passed through the detection point of the sensor SE8. Then, at step S126, whether the distance between the leading edge of the foregoing sheet and the detection point of the sensor 8 is equal to the distance between the leading edge of a following sheet which is being transported in the vertical path 151 and the detection point of the sensor SE7 is checked. Because the sensor SE8 cannot measure the amount of transportation, the amount of transportation of the foregoing sheet is recognized from the detection of the following sheet by the sensor SE7. When the distances are equal, it is confirmed at step S127 that the foregoing sheet stops, and the vertical transport roller pair 161 is stopped at step S128.

TABLE 5a

| (Control for a Stop of Vertical Transport Roller Pair in Cases of Single Holding) | | |
|---|---|---|
| 1 Color | Condition | The foregoing sheet stops. |
| | Timing | The distance between the leading edge of the foregoing sheet and the detection point of the sensor SE8 is equal to the distance between the leading edge of the following sheet and the detection point of the sensor SE7. |
| 2 Colors | Condition | |
| | Timing | |
| 3 Colors | Condition | |
| | Timing | |
| 4 Colors | Condition | |
| | Timing | |

TABLE 5b

| (Control for a Stop of Vertical Transport Roller Pair in Cases of Double Holding) | | |
|---|---|---|
| 1 Color | Condition | Transportation of the foregoing sheet is less than a specified amount. |
| | Timing | A sheet is transported by a specified amount, which depends on the sheet size, after passing through the discharging roller pair. |
| 2 Colors | Condition | The foregoing sheet is detected by the sensor SE8. |
| | Timing | A sheet is transported by a specified amount, which depends on the sheet size, after passing through the discharging roller pair. |
| 3 Colors | Condition | The foregoing sheet is detected by the sensor SE8. |
| | Timing | A sheet is transported by a specified amount, which depends on the sheet size, after passing through the discharging roller pair. |
| 4 Colors | Condition | The foregoing sheet is detected by the sensor SE8. |
| | Timing | A sheet is transported by a specified amount, which depends on the sheet size, after passing through the discharging roller pair. |

Figure 28:
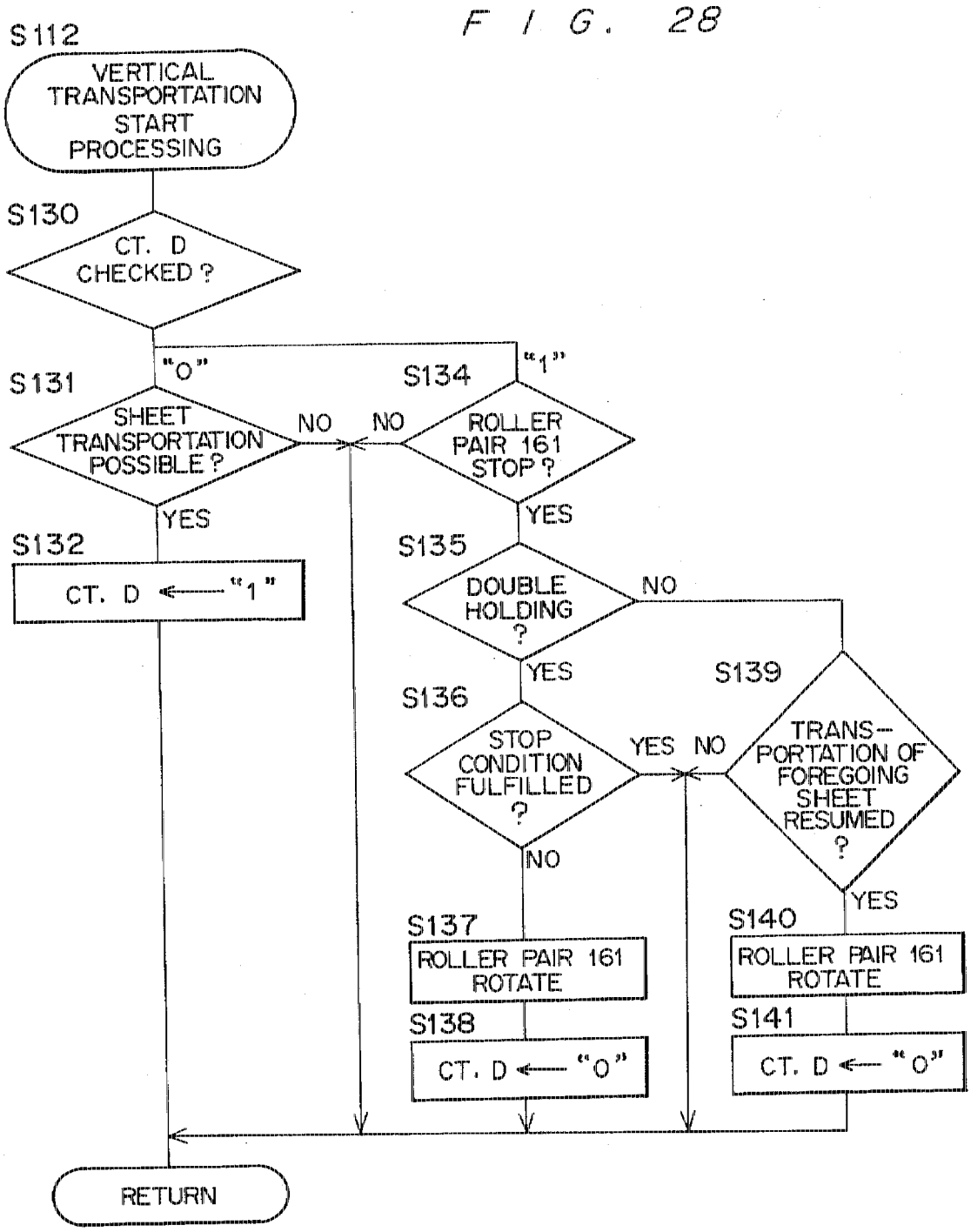
FIG. 28 is a flowchart which shows a subroutine for vertical transportation start processing.

FIG. 28 shows a subroutine for vertical transportation start processing carried out at step S112. This subroutine is to rotate the vertical transport roller pair 161 to start transportation of a sheet.

First, the value of a state counter D (initial value is "0") is checked at step S130, and the processing proceeds according to the value.

When the state counter D is "0", at step S131, whether the copying machine 10 is operating, which means that a sheet will be possibly transported, is checked. If "YES", the state counter D is set to "1", at step S132.

When the state counter D is "1", it is confirmed at step S134 that the vertical transport roller pair 161 stops, and whether the transfer drum 51 has performed double holding is judged at step S135. If "YES", whether the condition shown by Table 5b is fulfilled is judged at step S136. If the condition is not fulfilled, the vertical transport roller pair 161 is rotated at step S137. Then, the state counter D is reset to "0". On the other hand, if the transfer drum 51 has performed single holding ("NO" at step S135), at step S139, whether transportation of the foregoing sheet is resumed is judged. When the transportation is resumed, the vertical transport roller pair 161 is rotated at step S140, and the state counter D is reset to "0".

Figure 29A:
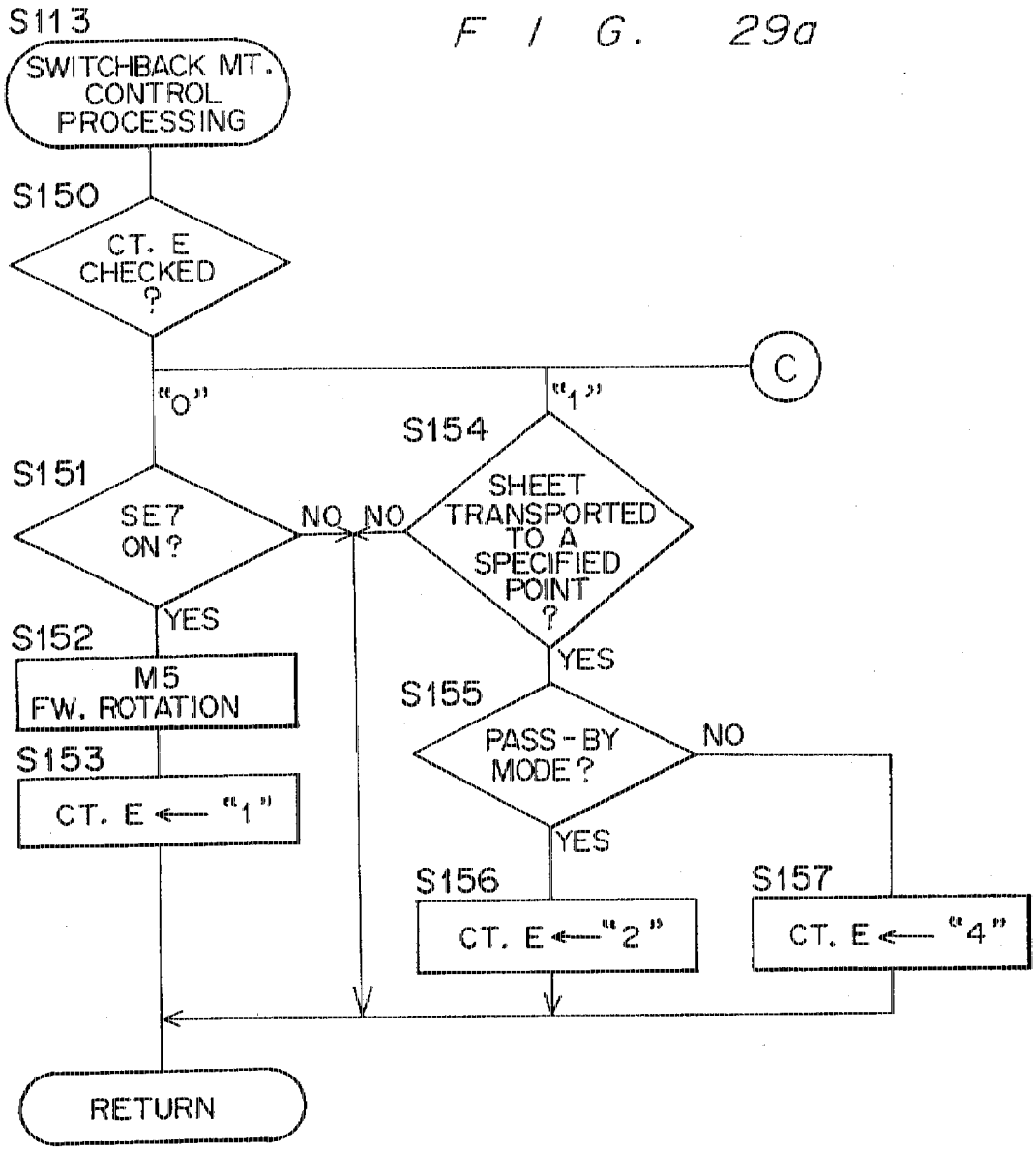
FIGS. 29*a* through 29*c* are flowcharts which show a subroutine for switchback motor control processing.
Figure 29B:
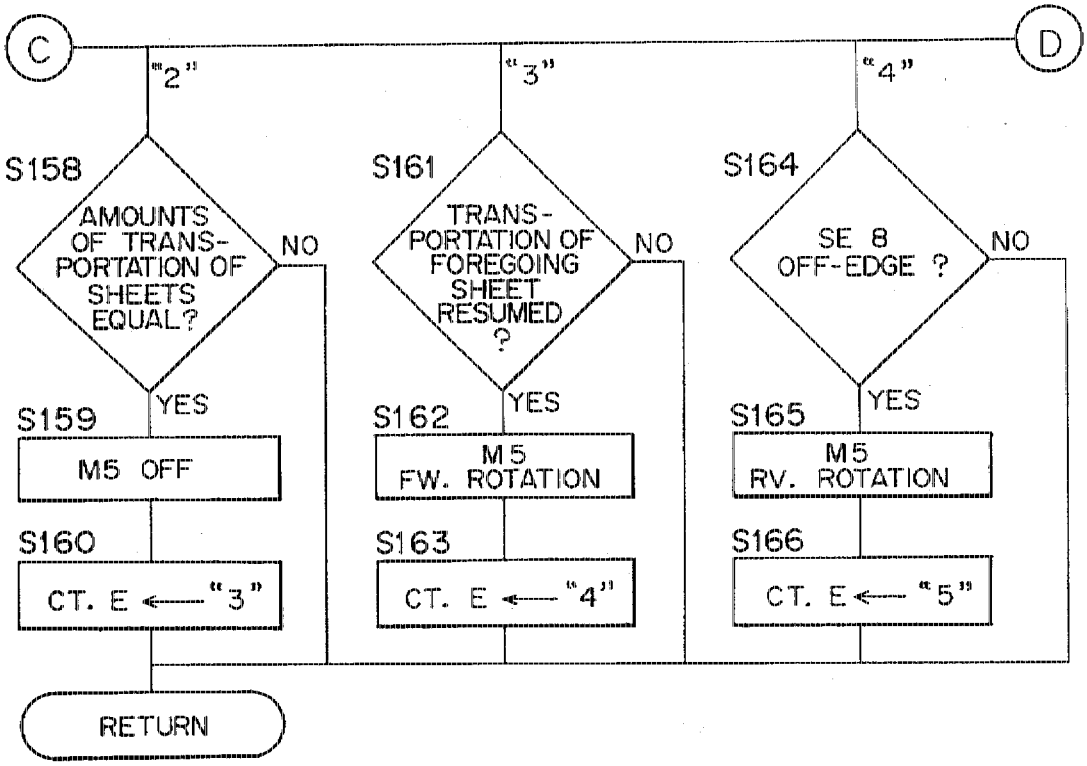
Figure 29C:
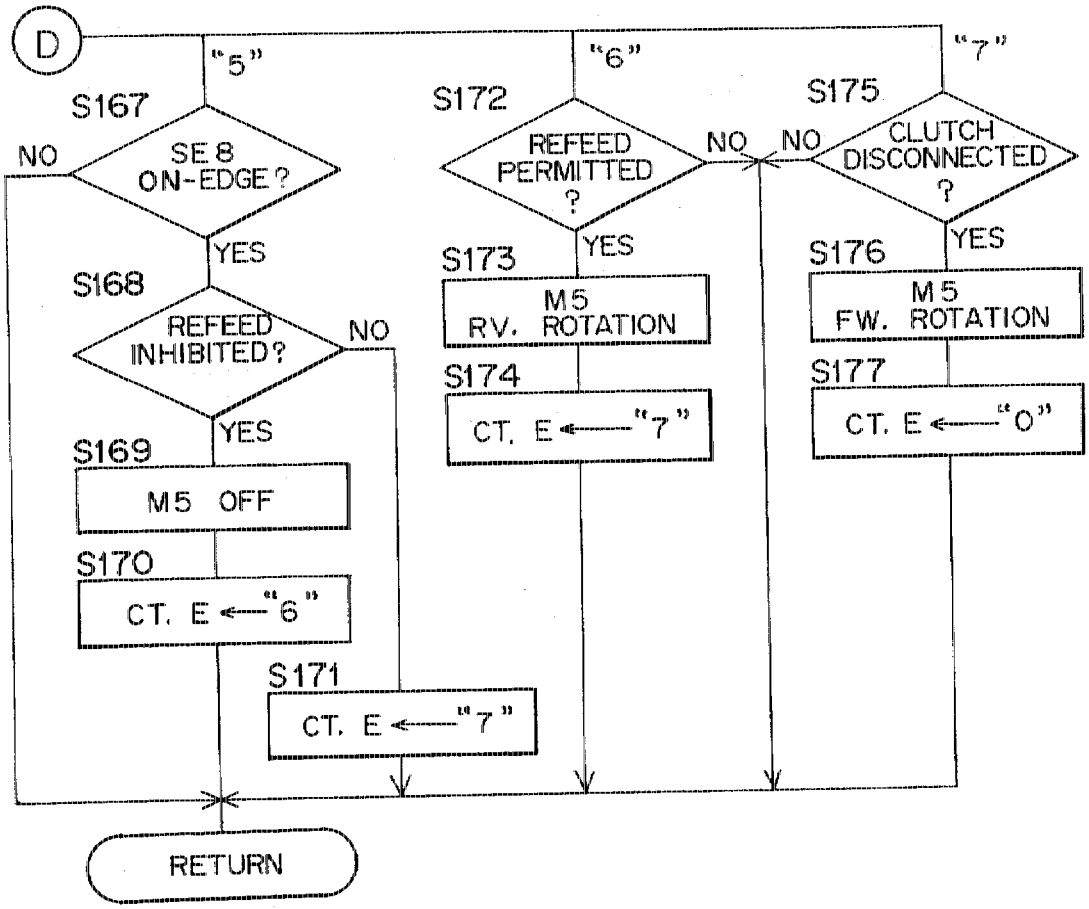

FIGS. 29*a* through 29*c* show a subroutine for the switchback motor control processing carried out at step S113. This subroutine is to control forward/reverse rotation of the switchback motor M5. However, forward/reverse rotation of the switchback roller pair 162 is actually controlled by a subroutine shown by FIG. 30.

First, the value of a state counter E (initial value is "0") is checked at step S150, and the processing proceeds according to the value.

When the state counter E is "0", whether the sensor SE7 is on is judged at step S151. When the sensor SE7 is on, which means that a sheet exists in the vertical path 151, at step S152, the switchback motor M5 is turned on for forward rotation. Then, the state counter E is set to "1".

When the state counter E is "1", at step S154, whether the leading edge of the sheet comes to a specified point immediately before the switchback roller pair 162. This judgment is carried out by starting a timer at the moment of an on-edge of the sensor SE7. When the leading edge of the sheet comes to the specified point, whether the pass-by mode is set is judged at step S155. If the pass-by mode is set, the state counter E is set to "2" at step S156, and if the stand-by mode is set, the state counter E is set to "4" at step S157.

When the state counter E is "2", at step S158, whether the distance between the leading edge of the foregoing sheet and the detection point of the sensor SE8 is equal to the distance between the leading edge of the following sheet which is in the vertical path 151 and the detection point of the sensor SE7 is judged. When the distances are equal, the switchback motor M5 is turned off at step S159, and the state counter E is set to "3" at step S160.

When the state counter E is "3", resumption of transportation of the foregoing sheet is confirmed at step S161, and the switchback motor M5 is turned on at step S162. Then, the state counter E is set to "4" at step S163.

When the state counter E is "4", at step S164, whether the sensor SE8 is off-edge is judged. When the sensor SE8 is off-edge, which means that the trailing edge of the sheet has passed the detection point of the sensor SE5, at step S165, the switchback motor M5 is turned on for reverse rotation. Then, the state counter E is set to "5" at step S166.

When the state counter is "5", at step S167, whether the sensor SE8 is on-edge is judged. When the sensor SE8 is on-edge, which means that the leading edge of the switchbacked sheet has reached the detection point of the sensor SE8, at step S168, whether the image forming section 40 is operating for image formation, that is, whether refeed of the sheet should be waited is judged. If "YES", the switchback motor M5 is turned off at step S169, and the state counter E is set to "6" at step S170. If "NO", the state counter E is set to "7" at step S171.

When the state counter E is "6", permission to refeed the sheet is confirmed at step S172, and the switchback motor M5 is turned on for reverse rotation at step S713. Then, the state counter E is set to "7" at step S174.

When the state counter E is "7", at step S175, whether the clutch between the switchback motor M5 and the switchback roller pair 162 is disconnected, which is done when the leading end portion of the sheet is nipped between the refeeding roller pair 163, is judged. When the clutch is disconnected, the switchback motor M5 is turned on for forward rotation at step S176, and the state counter E is reset to "0" at step S177.

Figure 30:
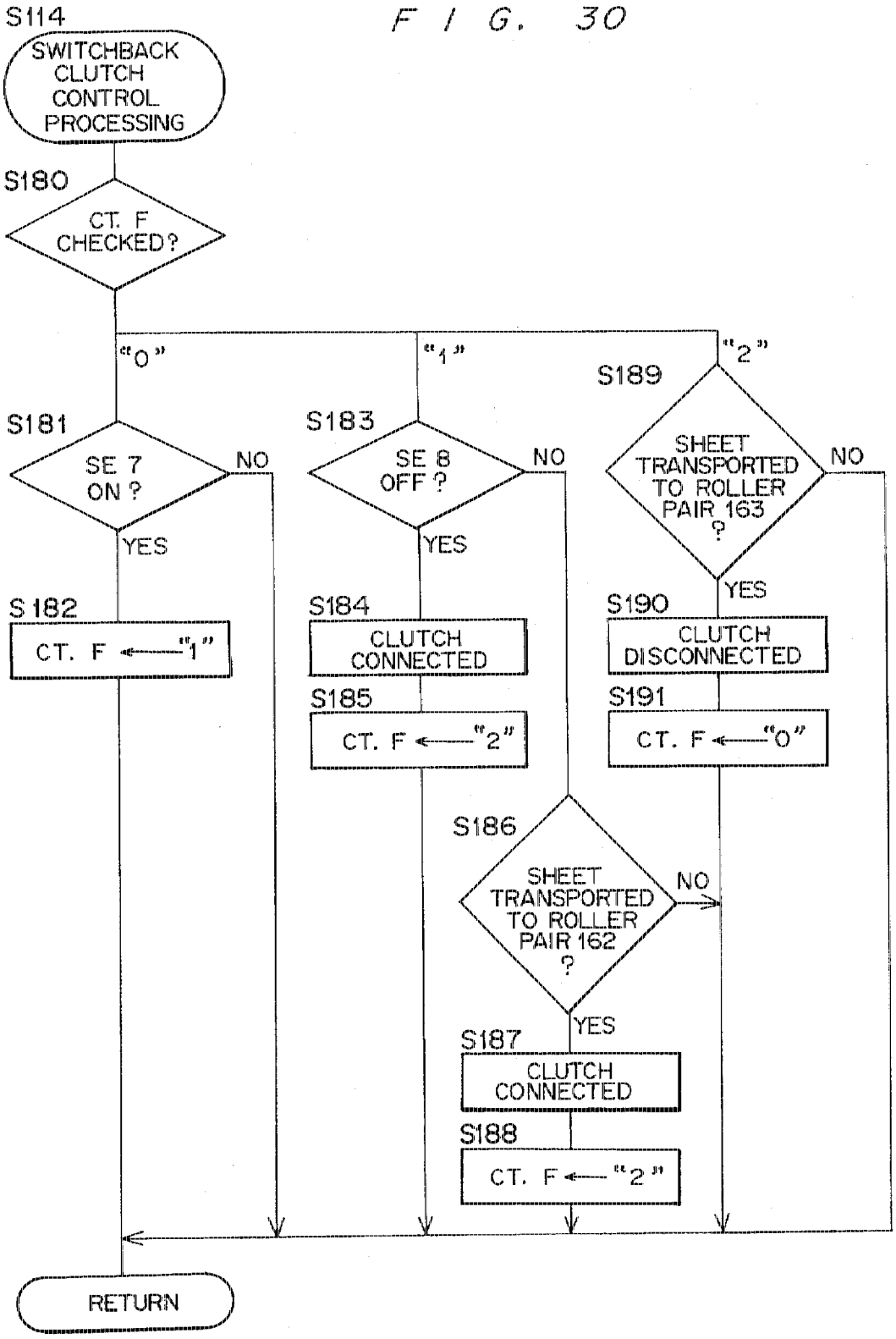
FIG. 30 is a flowchart which shows a subroutine for switchback clutch control processing.

FIG. 30 shows a subroutine for the switchback clutch connection/disconnection processing which is carried out at step S114. This subroutine is to control connection/disconnection of the clutch between the switchback motor M5 and the switchback roller pair 162. The direction of transportation of a sheet depends on the direction of rotation of the switchback motor MS, forward or reverse, set in the above-described switchback motor control processing subroutine.

First, the value of a state counter F (initial value is "0") is checked at step S180, and the processing proceeds according to the value.

When the state counter F is "0", at step S181, whether the sensor SE7 is on is judged. When the sensor SE7 is on, which means that a sheet exists in the vertical path 151, the state counter F is set to "1" at step S182.

When the state counter F is "1", at step S183, whether the sensor SE8 is off is judged. If the sensor SE8 is off, that is, if there is no foregoing sheet or if a foregoing sheet has already passed through the detection point of the sensor SE8, the clutch between the switchback motor M5 and the switchback roller pair 162 is connected at step S184. Then, the state counter F is set to "2" at step S185. On the other hand, if the sensor SE8 is on, that is, if a foregoing sheet is detected by the sensor SE8 (pass-by mode), at step S186, whether the following sheet has reached the switchback roller pair 162 is judged. When the sheet has reached the switchback roller pair 162, the clutch is connected at step S187, and the state counter F is set to "2" at step S188.

When the state counter F is "2", it is confirmed at step S189 that the sheet (foregoing sheet in a case of "NO" at step S183) has come to the nip portion of the refeeding roller pair 163, and the clutch is disconnected at step S190. Then, the state counter F is reset to "0".

Figure 31:
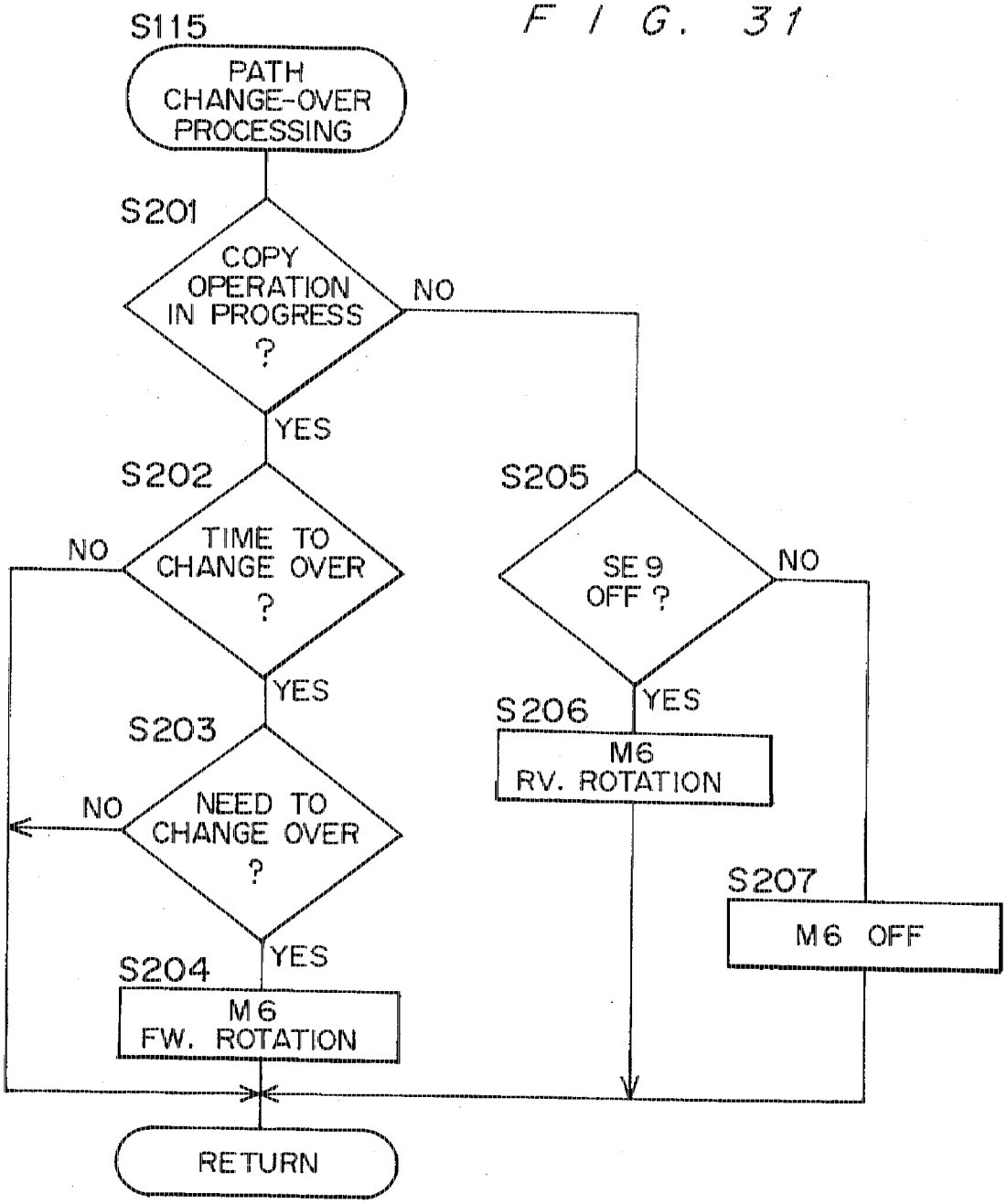
FIG. 31 is a flowchart which shows a subroutine for path change-over processing.

FIG. 31 shows a subroutine for the transport path change-over processing which is carried out at step S115.

First at step S201, whether a copying operation is in progress is judged. If in the middle of a copying operation, whether it is a time to change over the transport path is judged at step S202, and whether a change-over is necessary is judged at step S203. The time for a change-over depends on the operation mode of the duplex sorter 100 and the number of copy sets to be made.

An operation in the non-sort mode is described. When the leading edge of the first sheet reaches the discharging roller pair 73, the judgments at steps S202 and S203 become "YES", and the change-over motor M6 is turned on at step S204. In this case, the change-over motor M6 moves down the cam 170 by one step from the home position to actuate the first change-over pawl 121 (see FIG. 4). Thereby, the sheet is guided onto the first bin 101. In the non-sort mode, the cam 170 is kept in the position while the following sheets are discharged from the copying machine 10. When the last sheet has been transported into the first bin 101, and more specifically, when a specified time has passed since detection of the trailing edge of the last sheet by the sensor SE6, the judgments at steps S202 and S208 become "YES", and the change-over motor M6 is turned on at step S204 to move the cam 170 back to the home position.

An operation in the sort mode is described. As in the non-sort mode, when the first sheet is discharged from the copying machine 10, the change-over motor M6 is turned on to move down the cam 170 by one step from the home position to actuate the first change-over pawl 121. When the first sheet has been transported in the first bin 101, and more specifically, when the specified time has passed since detection of the trailing edge of the first sheet by the sensor SE6, the judgment at step S202 becomes "YES". Further, if there is a following sheet (second sheet), the judgment at step S203 is "YES". Therefore, the change-over motor M6 is turned on to move down the cam 170 by one step more to actuate the second change-over pawl 122 (see FIG. 5). Thereby, the second sheet is transported onto the second bin 102. Thereafter, similar processing is carried out.

In the sort mode, when making two or more copy sets, reciprocative delivery is carried out. A case of making three copy sets is described as an example. Copying begins with the last page (page n) of documents. After delivery of the third copy sheet of page n to the third bin 103 is completed, the cam 170 is kept in the position to actuate the third change-over pawl 123, whereby the first copy sheet of page (n−1) is delivered to the third bin 103. Then, the change-over motor M6 is rotated in reverse to move up the cam 170 by one step to a position to actuate the second change-over pawl 122, whereby the second copy sheet of page (n−1) is delivered to the second bin 102. In the sort mode, for delivery of copy sheets, the cam 170 actuates the change over pawls 121, 122, 123, 123, 122, 121, 121, 122, 123 in order. In refeeding a sheet, the change-over motor M6 is not driven, and the cam 170 is kept in the home position.

If not in the middle of a copying operation ("NO" at step S201), at step S205, whether the home position sensor SE9 is off is judged. If the sensor SE9 is off, which means that the cam 170 is not in the home position, the change-over motor M6 is driven in reverse at step S206 to move the cam 170 back to the home position. When the sensor SE9 is turned on, the change-over motor M6 is turned off at step S207.

According to the above-described subroutine for the transport path change-over processing, a change-over is carried out in response to detection of the trailing edge of a sheet by the sensor SE6. However, the timing of a change-over may be determined based on detection of the leading edge of a sheet by the sensor SE6 or detection of the leading edge or the trailing edge of a sheet by the discharging sensor SE1. Also, when the first sheet is to be delivered to the first bin 101, it is possible to move down the cam 170 by one step from the home position simultaneously with start of the copying operation.

The present invention is applicable to a monochromatic copying system which uses only black toner as well as a full color copying system. A monochromatic copying system does not need a transfer drum. Although the above-described embodiment is a digital type copying system in which a document image is read by an image reader unit and an electrostatic latent image is formed by a laser beam scanning unit, the present invention is applicable to an analog type copying system as well.

In the embodiment, the sheet circulating section is combined with a sorter. However, it is possible to provide the sheet circulating section by itself in a copying system.

Although the present invention has been described in connection with the preferred embodiment, it is to be noted that various changes and modifications are possible to those who are skilled in the art. Such changes and modifications are to be understood as being within the scope of the present invention.

What is claimed is:

1. A copying system comprising:

a document table;

copying means for forming an image of a document set on the document table on a sheet;

document reversing means for turning over a document set on the document table;

sheet transporting means for receiving the sheet with an image formed on a first side of the sheet from the copying means, turning over the sheet and refeeding the sheet to the copying means for image formation on a second side of the sheet; and control means for, when, in a duplex copy mode in which images are formed on both sides of a sheet, a double-side document which has images on both sides is to be copied to make a number of copies over a capacity of the sheet transporting means, controlling the document reversing means to turn over the document every time a number of copies corresponding to the capacity of the sheet transporting means has been made.

2. A copying system as claimed in claim 1, wherein the control means sets a limit to a number of times of reversion of the document.

3. A copying system as claimed in claim 2, wherein the control means sets a limit to a number of times of reversion of a document, depending on a kind of the document.

4. A copying system as claimed in claim 2, wherein if a number of copies inputted by an operator is over a copy limit which is calculated from the capacity of the sheet transporting means and the limit set to the number of times of reversion of the document, the control means gives a warning.

5. A copying system as claimed in claim 2, wherein when a number of copies inputted by an operator is over a copy limit which is calculated from the capacity of the sheet transporting means and the limit set to the number of times of reversion of the document, the control means controls the sheet reversing means and the copying means to make copies to the copy limit regardless of the inputted number of copies.

6. A method, in a copying system provided with sheet transporting means for receiving a sheet with an image formed on a first side of the sheet from a copying section, turning over the sheet and refeeding the sheet to the copying section for image formation on a second side of the sheet, for making a number of copies over a capacity of the sheet transporting means, said method comprising:

a first step of setting a document on a document table of the copying system;

a second step of copying a first side of the document on respective first sides of a number of sheets corresponding to the capacity of the sheet transporting means;

a third step of turning over the document and setting the document on the document table again upon completion of the second step;

a fourth step of copying a second side of the document on respective second sides of the sheets;

a fifth step of turning over the document and setting the document on the document table again upon completion of the fourth step; and a sixth step of repeating a cycle from the second step to the fifth step until a number of copies inputted by an operator have been made.

7. A method as claimed in claim 6, wherein:

the copying system set a limit to a number of times of reversion of the document; and if the number of copies inputted by the operator is over a copy limit which is calculated from the capacity of the sheet transporting means and the limit set to the number of times of reversion of the document, in the sixth step, a copying operation is terminated when copies are made to the copy limit.

* * * * *